US008528715B2

(12) United States Patent
Seki et al.

(10) Patent No.: US 8,528,715 B2
(45) Date of Patent: Sep. 10, 2013

(54) MODULARIZED DOCUMENT HANDLER

(75) Inventors: Toru Seki, Tokyo (JP); Nobuo Takashima, Tokyo (JP)

(73) Assignee: Japan Cash Machine Co., Ltd., Osaka (JP)

( * ) Notice: Subject to any disclaimer, the term of this patent is extended or adjusted under 35 U.S.C. 154(b) by 289 days.

(21) Appl. No.: 12/871,254

(22) Filed: Aug. 30, 2010

(65) Prior Publication Data

US 2011/0114441 A1 May 19, 2011

(30) Foreign Application Priority Data

Nov. 16, 2009 (JP) ..... 2009-261381

(51) Int. Cl.
*G07F 7/04* (2006.01)

(52) U.S. Cl.
USPC ..... 194/206

(58) Field of Classification Search
USPC ..... 194/203, 206, 350, 344, 349; 235/379, 235/381; 209/534; 902/8, 9, 11, 13, 14, 902/15; 109/50, 51, 52
See application file for complete search history.

(56) References Cited

U.S. PATENT DOCUMENTS

| | | | | |
|---|---|---|---|---|
| 5,372,361 | A * | 12/1994 | Isobe et al. | 271/181 |
| 5,740,897 | A * | 4/1998 | Gauselmann | 194/206 |
| 5,836,435 | A * | 11/1998 | Fujita et al. | 194/206 |
| 6,619,461 | B2 | 9/2003 | Saltsov et al. | |
| 6,932,208 | B1 | 8/2005 | Wen | |
| 2001/0017276 | A1 * | 8/2001 | Yasuda et al. | 209/534 |
| 2010/0289212 | A1 | 11/2010 | Nireki | |

FOREIGN PATENT DOCUMENTS

| | | |
|---|---|---|
| EP | 0662676 | 7/1995 |
| EP | 0762344 | 3/1997 |
| EP | 1443474 A1 | 8/2004 |
| JP | 2009-176143 | 8/2009 |
| WO | 2011/052189 A1 | 5/2011 |

OTHER PUBLICATIONS

International Search Report for PCT/JP2010/006667.
Supplementary European Search Report for EP Application No. 10829719.3 dated Jul. 10, 2013.

* cited by examiner

*Primary Examiner* — Mark Beauchaine
(74) *Attorney, Agent, or Firm* — Bachman & LaPointe, P.C.

(57) ABSTRACT

A document handler is provided which comprises an actuator 17, a power transmission device 8 drivingly connected to actuator 17, and anterior and posterior gears 11 and 12 rotated by drive power of actuator 17 through power transmission device 8. First and second driven devices may be drivingly and disengageably connected to anterior and posterior gears 11 and 12 to drive first and second driven devices by actuator 17.

13 Claims, 25 Drawing Sheets

MODULARIZED DOCUMENT HANDLER

TECHNICAL FIELD

This invention relates to a document handler driven by a modular drive device that may drive a plurality of different modular driven devices drivingly and disengageably connected to the drive device.

BACKGROUND OF THE INVENTION

U.S. Pat. No. 5,836,435 discloses a bill handling apparatus that comprises a validator means for validating a bill inserted into the apparatus, a stacker means for storing a bill in response to an output from the validator means when the bill is considered genuine by the validator means, a frame for supporting the stacker means, a coupling means provided between the validator means and frame for detachably supporting the validator means on the frame in the condition of alignment of the passageway in the validator means with a passageway of the stacker means, a connector means which comprises a plug and a jack, one of which is attached to a rear end of the validator means for electrical connection with a validator sensor, and the other is attached to a front end of the frame, and a power transmission means which comprises a drive gear rotatably supported on the frame, and a follower gear rotatably mounted on the validator means and disposed on the same plane of the drive gear.

The validator means includes conveyor means for transporting the bill along a passageway, and sensor means disposed adjacent to the passageway. When the validator means is attached to the frame through the connector means, the follower gear in the validator means automatically comes into engagement with the drive gear of the frame, and the plug and jack of the connector means are simultaneously and automatically engaged with each other to drive a conveyer means in the validator means by a motor provided outside the validator means and in the frame. Also, the sensor means in the validator means can forward its output to a validator control means provided outside the validator means and in the frame through the connector means. However, this bill handling apparatus is disadvantageous because a drive means and a pusher in the bill handling apparatus are not modularized for assembly and disassembly.

U.S. Pat. No. 5,372,361 demonstrates a bill handling apparatus which comprises a validator for checking a bill fed into the apparatus whether or not the bill is genuine, a stacker detachably mounted in the apparatus and having a casing for defining a compartment to store the accumulated bills, and a transporter for transporting the bill along a passageway from the validator to the stacker, a chamber defined by the casing of the stacker, a pusher removably located within the chamber of the stacker and drivingly connected with the transporter for pushing the bill into the compartment, an opening formed in the casing in the vicinity of the chamber for passing the pusher, and a slit-shaped inlet formed in a base plate of the pusher for receiving the bill within the pusher from an exit of the passageway of the transporter. However, this apparatus is inconvenient because the validator cannot be removed from the apparatus.

U.S. Pat. No. 6,619,461 represents a banknote validator that comprises a plurality of releasable components secured in a frame body, and electrical means for connecting the validator to an associated device allowing communication therebetween. The releasable components include a validating head for receiving and determining the authenticity of a banknote, a banknote storage arrangement for receiving banknotes accepted by the validator, and a power interface module for receiving power from the electrical means to provide any power conversion necessary for powering the validating head. This banknote validator comprises several releasable components, however, does not have any releasable power transmission device.

Accordingly, an object of the present invention is to provide a modularized document handler that comprises a modular drive device and a plurality of modular driven devices drivingly and detachably connected to the drive device to operate the driven devices by the drive device. Another object of the present invention is to provide a modularized document handler that comprises a drive device, a validator and a stacker each formed into a unit that may be organically and separably interlocked each other for integral driving of the validator and stacker by the drive device. Still another object of the present invention is to provide a modularized document handler that comprises a drive device, a validator and a stacker organically and separably unitized each other to consistently and continuously transport a document inserted into the validator through the drive device to the stacker.

SUMMARY OF THE INVENTION

The modularized document handler according to the present invention, comprises a validator (2) for validating a document (35), a stacker (3) for stowing document (35) sent from validator (2) and a drive device (1) for transporting document (35) from validator (2) to stacker (3). Drive device (1) comprises an actuator (17), a power transmission device (8) driven by actuator (17), anterior and posterior gears (11, 12) both driven by drive power from actuator (17) through power transmission device (8). Validator (2) and stacker (3) are drivingly and disengageably connected to respectively anterior and posterior gears (11, 12) to operate validator (2) and stacker (3) by drive power from actuator (17) to consistently transport a document (35) from a passageway (10) formed in validator (2) through an intermediate path (48) formed in drive device (1) to stacker (3). The document handler is advantageous because validator (2) and stacker (3) may be disengaged from respectively anterior and posterior gears (11, 12) for easy assembly, disassembly, repair, maintenance, check, overhaul or exchange or the like.

Another modularized document handler according to the present invention, comprises an actuator (17), a power transmission device (8), a support frame (22) formed with a pair of hinges (160) for sustaining actuator (17) and power transmission device (8) as a single drive unit (13), and a case (15) for accommodating drive unit (13). Case (15) is formed with a pair of bearings (161) capable of detachably and rotatably receiving hinges (160) of support frame (22). Drive unit (13) is easily mounted in position within case (15) by detachably fitting hinges (160) in mating bearings (161) and then rotating drive unit (13) toward inside of case (15). Drive device (1), validator (2) and stacker (3) are independently assembled as discrete and different modules or units that may be organically and separably interlocked for integral driving of validator (2) and stacker (3) by drive device (1) to consistently transport a document (35) from validator (2) through drive device (1) to stacker (3). The document handler is advantageous because drive device (1), validator (2) and stacker (3) may be disengaged from each other for easy assembly, disassembly, repair, maintenance, check or exchange or the like.

A still further modularized document handler according to the present invention comprises a drive device (1) and a validator (2) drivingly and disengageably connected to drive device (1). Drive device (1) comprises an actuator (17) and a power transmission device (8) driven by actuator (17), an anterior gear (11) driven by actuator (17) through a power transmission device (8), a support frame (22) for sustaining an incorporate drive unit (13) made up of actuator (17), power transmission device (8) and anterior gear (11), and a case (15) for accommodating incorporate drive unit (13). Validator (2) comprises a passageway (10) and a conveyer device (5) for conveying a document (35) along passageway (10). Conveyer device (5) has an input gear (21) drivingly and disengageably connected to anterior gear (11) of drive device (1).

According to the present invention, the drive device can be drivingly and detachably connected to driven devices such as validator and stacker to synchronously energize the drive device and driven devices by an actuator provided in the drive device in the organically interlocked fashion without need of any additional actuator or actuators in the driven devices. Also, the drive and driven devices may make up individually discrete or independent modules or units that may be drivingly and separably connected to each other for improvement in easy assembly, disassembly, maintenance, check, exchange of the drive and driven devices, and concurrently this structure effectively proves useful in reductions in number of assembled parts, weight of the apparatus and production costs. Moreover, when the validator and stacker are drivingly and disengageably connected to the drive device in the organically interlocked relation to each other, a document can be continuously sent from the validator through the drive device to the stacker.

BRIEF DESCRIPTION OF THE DRAWINGS

The above-mentioned and other objects and advantages of the present invention will be apparent from the following description in connection with preferred embodiments of the modularized document handler applied to a bill handling apparatus shown in the accompanying drawings wherein.

BEST MODE FOR CARRYING OUT THE INVENTION

Figure 1:
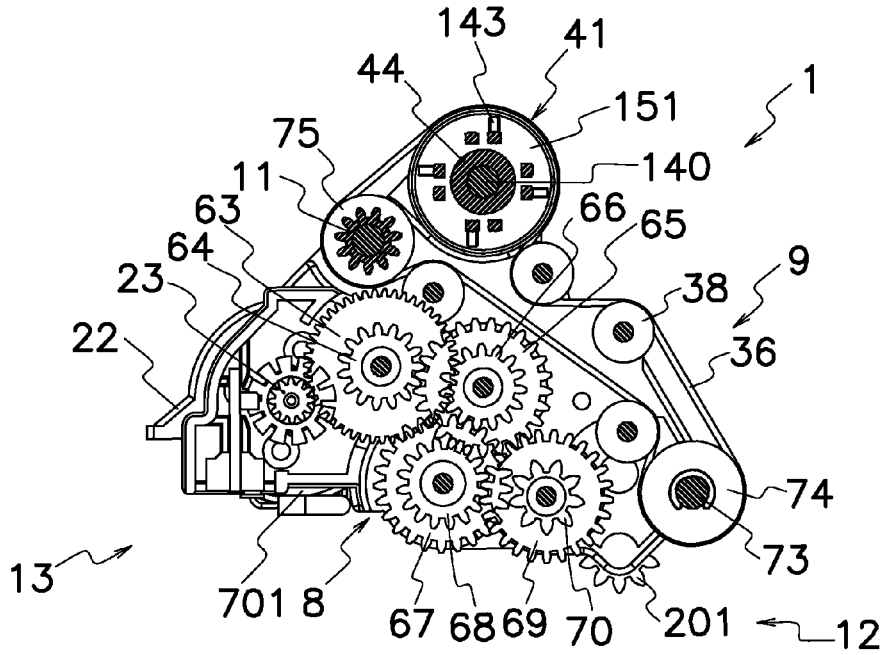
FIG. 1 is a front view of a drive device for use in a modularized document handler according to the present invention.

Described hereinafter in connection with FIGS. 1 to 33 of the drawings will be embodiments of a bill handling apparatus as a highly-modularized document handler according to the present invention. These embodiments exemplify and instantiate an example of a practical and concrete bill handling apparatus that incorporates a drive device 1, a validator 2, a stacker 3 and a frame 4 all of which are modularized into discrete units and are assembled into the bill handling apparatus. In the description herein, a word "unit" for drive device 1, validator 2, stacker 3 and frame 4 has the same meaning as a discrete incorporable "module", "block" or "package", and a word "modularize" has the same meaning as "unitize", "package" and "lump together". In addition, a word "detachable" has the same meaning as "removable", "separable", "dismountable". A word "document" means a bill, bank note, coupon, security, tender, token, scrip or all other valuable paper. The embodiments of the present invention may include as driven devices a conveyer device, a carrier device, a pusher device, a transport device and an anti-pullback unit, however, it is apparent that one of ordinary skill in the art would be able to select a plurality of necessary driven devices, to remove unnecessary driven device or devices or to add another device or other devices undisclosed herein to one or more of devices driven by the drive device in the present invention.

[1] Structure of Drive Device

FIGS. 1 to 4 indicate a drive unit 13 of generally triangular section for use in a drive device 1 of a bill handling apparatus according to the present invention. Drive unit 13 comprises an actuator 17, power transmission devices 8 driven by actuator 17, and a support frame 22 for sustaining actuator 17 and power transmission devices 8 as a unit. As seen from FIGS. 6 and 7, drive device 1 has drive unit 13 and a case 15 for accommodating drive unit 13. Not shown in the drawings, however, disposed within case 15 is a drive control device electrically connected to drive unit 13 to control operation of drive unit 13. As shown in FIG. 7, drive device 1 is drivingly and separably connected to a conveyer device 5 in a validator 2 as a first driven device to operate conveyer device 5 by drive device 1.

Figure 13:
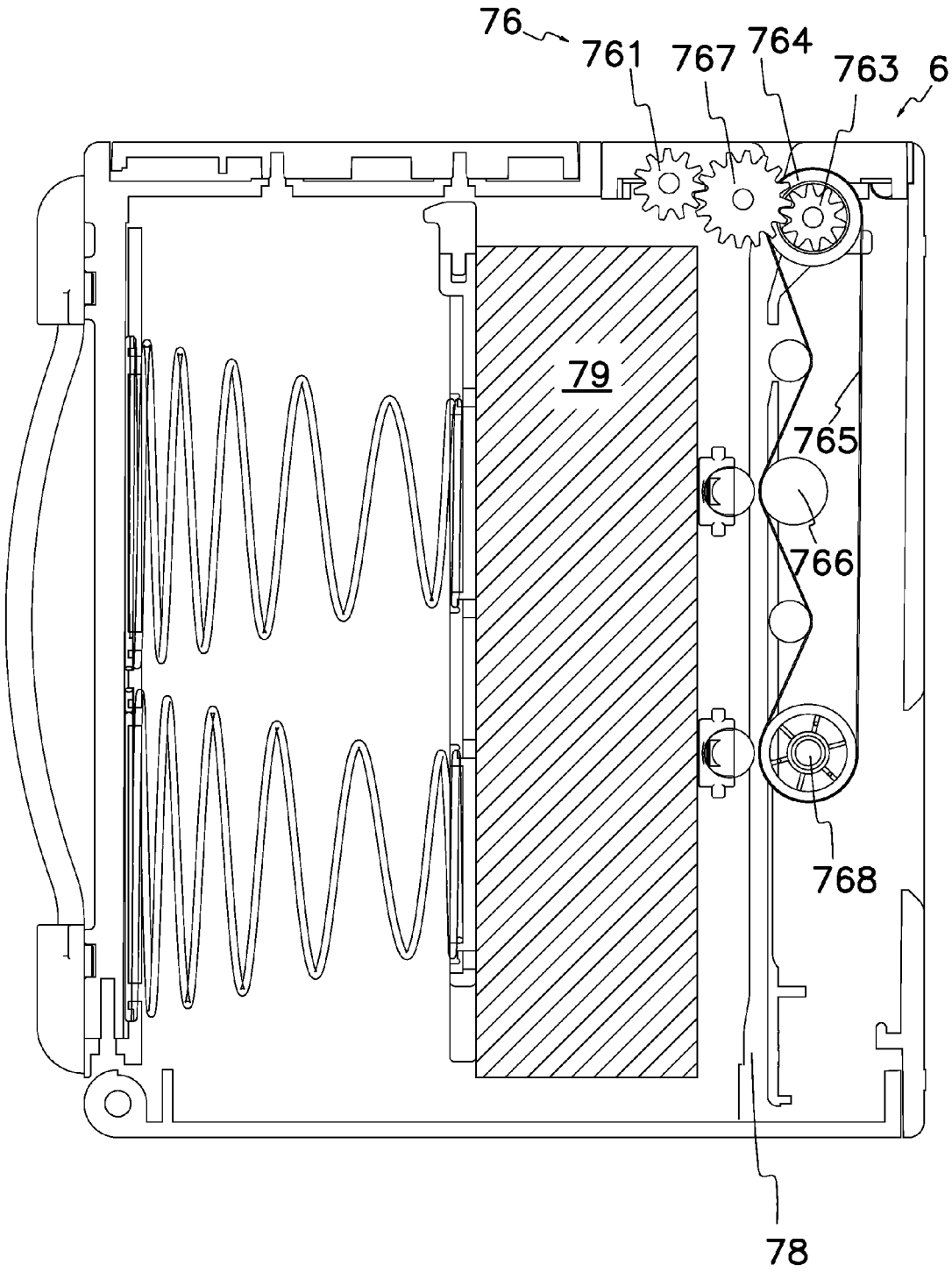
FIG. 13 is a sectional view of a stacker having a built-in carrier device.
Figure 14:
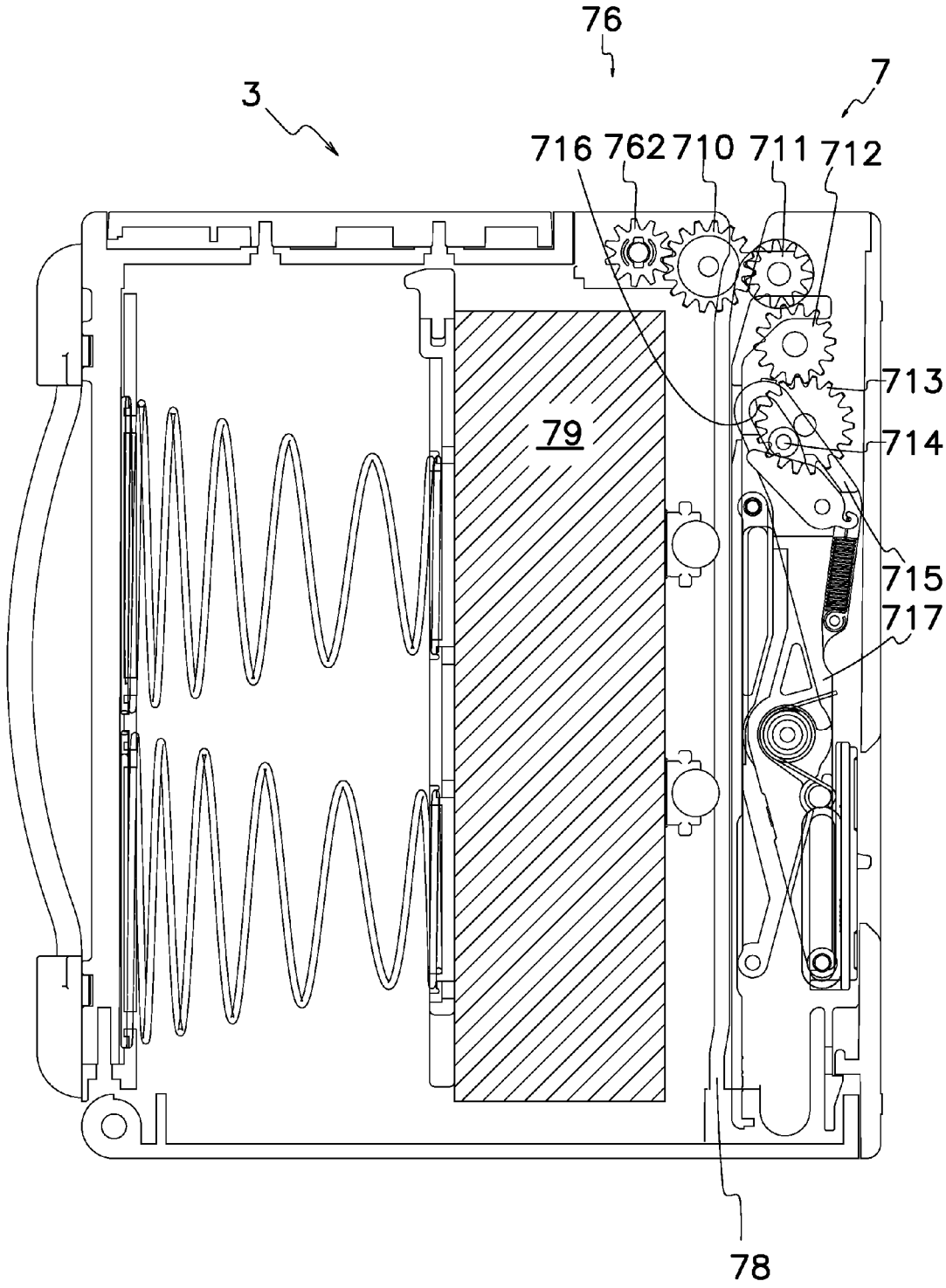
FIG. 14 is a sectional view of the stacker having a built-in pusher device.

As depicted in FIG. 7, drive device 1 comprises a partially-arcuate intermediate path 48, and a transport device 9 as a fourth driven device drivingly connected to actuator 17 through power transmission device 8 for transporting bill 35 along intermediate path 48 in drive device 1. An inlet 48*a* of intermediate path 48 (FIG. 10) is communicated to a passageway 10 in a validator 2, and an outlet 48*b* of intermediate path 48 is communicated to a standby chamber 78 in a stacker 3 (FIGS. 13 and 14).

In the shown embodiment of the invention, actuator 17 comprises a reversible transport motor 701 rotatable in the forward and adverse directions, and a stowing motor 702. Transport motor 701 has a drive shaft for supporting a pinion 23 drivingly connected to power transmission device 8 to drive it by transport motor 701. Then, power transmission device 8 is drivingly connected to transport device 9 and a transport gear 201 as one of posterior gears 12. Transport device 9 is then drivingly connected to an anti-pullback unit 41 and an anterior gear 11 in turn. Stowing motor 702 is drivingly connected to a stowing gear 202 as the other of posterior gears 12 through an additional power transmission device that has same or similar constructions as shown pinion 23 and power transmission device 8 so that additional power transmission device is rotatably mounted on same shafts. Reduction ratio or number of gear teeth in additional power transmission device connected to stowing gear 202 may be different from that of power transmission device 8.

Transport device 9 and posterior gears 12 are drivingly connected in parallel to power transmission device 8, and anti-pullback unit 41 and anterior gear 11 are drivingly connected in parallel to transport device 9. This embodiment adopts the above gear train order or sequence of power transmission device 8, transport device 9, posterior and anterior gears 12 and 11, however, one of ordinary skill in the art would be able to change the train order as necessary. Anterior gear 11 is drivingly connected to an input gear (a first driven gear) 21 in conveyer device 5 through output gear 39 (FIG. 7), and posterior gears 12 are made up of transport and stowing gears 201 and 202 that are drivingly connected to respectively a carrier gear 761 in carrier device 6 of stacker 3 (FIG. 13) and a pusher gear 762 in a pusher device 7 of stacker 3 (FIG. 14). Carrier gear 761 is used to rotate carrier device 6 in stacker 3 to transport bill 35 from drive device 1 into standby chamber 78 in stacker 3, and pusher gear 762 is used to activate pusher device 7 to stow bill 35 in standby chamber 78 into storage 79. Carrier and pusher gears 761 and 762 are inclusively shown as drive gears 76.

Figure 5:
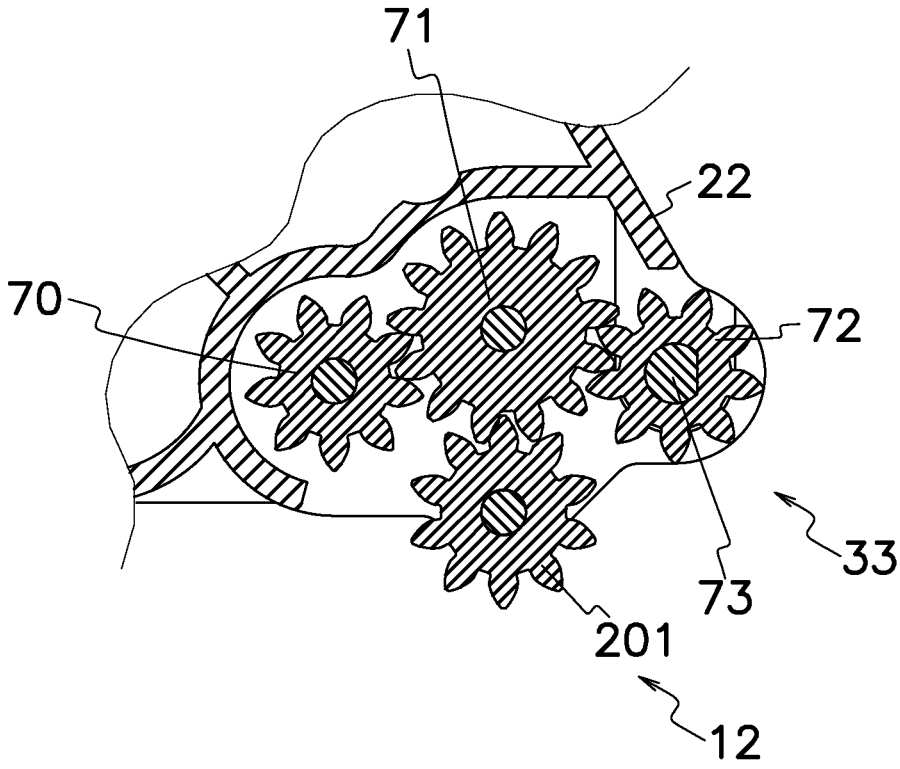
FIG. 5 is a partial sectional view of a posterior gear in the drive device.

Power transmission device 8 comprises a third gear 63 meshed with ah pinion 23 of transport and stowing motors 701 and 702, a fourth gear 64 mounted on a shaft of third gear 63, a fifth gear 65 meshed with fourth gear 64, a sixth gear 66 mounted on a shaft of fifth gear 65, a seventh gear 67 meshed with sixth gear 66, an eighth gear 68 mounted on a shaft of seventh gear 67, a ninth gear 69 meshed with eighth gear 68, a tenth gear 70 mounted on a shaft of ninth gear 69, and an eleventh gear 71 meshed with tenth gear 70 as shown in FIG. 5. Eleventh gear 71 is engaged with twelfth gear 72 that comprises transport and stowing gear 201 in posterior gears 12. As in power transmission device 8, additional power transmission device has similar gears as those 63 to 72 and stowing gear 202 in posterior gears 12.

As shown in FIG. 5, transport device 9 comprises twelfth gear 72 meshed with eleventh gear 71, a first pulley 74 (FIG. 1) mounted on a hinge shaft 73 of twelfth gears 72, a drive belt 36 wound around first pulley 74, a plurality of idle rollers 38 in contact to drive belt 36 to hold it in position, a second pulley 75 mounted on a shaft for supporting anterior gear 11, and a drive pulley 32 mounted on a shaft 140 of anti-pullback unit 41 to wind drive belt 36 around drive pulley 32. Anterior gear 11 is rotatably mounted on a shaft of second pulleys 75 in drive unit 13 to disengageably mesh anterior gear 11 with output gear 39 (FIG. 7) rotatably mounted within case 15. In this way, transport and stowing motors 701 and 702 in actuator 17 can drive, through power transmission devices 8, five driven devices that contain a first driven device: conveyer device 5 in validator 2 drivingly connected to anterior gear 11; second and third driven devices: carrier and pusher devices 6 and 7 drivingly connected to transport and stowing gears 201 and 202 in posterior gears 12; a fourth driven device: transport device 9 with first pulley 74 drivingly connected to twelfth gear 72; and a fifth driven device: anti-pullback unit 41 with rotor 42 drivingly connected to drive belt 36.

[2] First Driven Device=Conveyer Device

As illustrated in FIG. 7, input gear 21 in conveyer device 5 of validator 2 as first driven device is drivingly and disengageably connected to output gear 39 in drive device 1 to drive input gear 21 by rotation of actuator 17 through power transmission device 8, anterior gear 11 and output gear 39. An inlet sensor (not shown) is provided in validator 2 to detect insertion of bill 35 into an inlet 14 of passageway 10 and produce a detection signal that is used to rotate transport motor 701 in the forward direction. Thus, conveyer device 5 is rotated in the forward direction to transport bill 35 along passageway 10 toward drive device 1. Discrimination sensors (not shown) are deployed in validator 2 to photo-electrically or magneto-electrically detect physical features of bill 35 to produce pattern signals. A drive control device (not shown) in case 15 receives pattern signals from discrimination sensors to discriminate authenticity of bill 35 in view of pattern signals. When drive control device decides bill 35 as false, it rotates transport motor 701 and conveyer device 5 in the adverse direction to return bill 35 to inlet 14 in validator 2.

Figure 6:
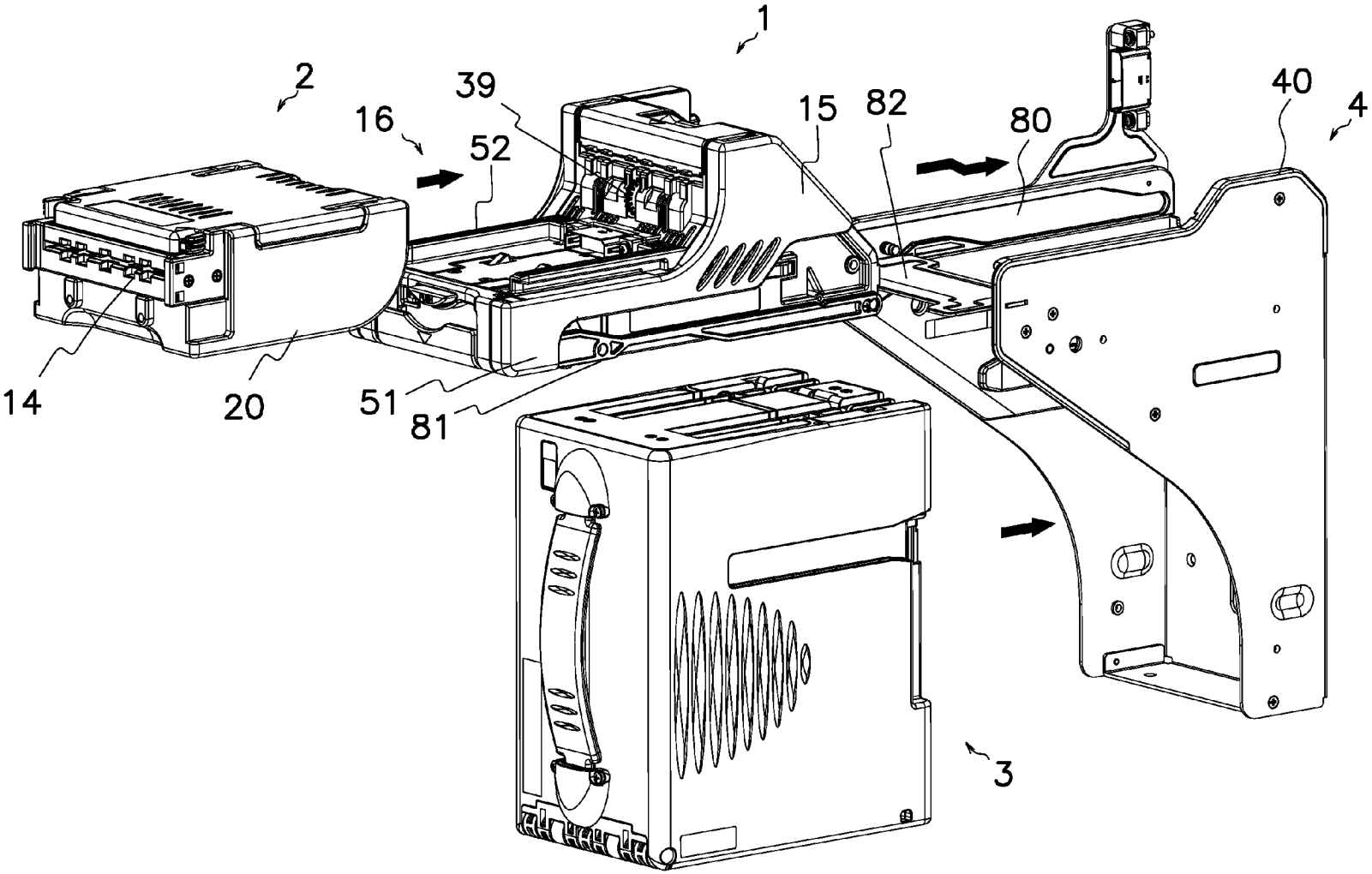
FIG. 6 is an exploded perspective view of a bill handling apparatus according to the present invention.
Figure 7:
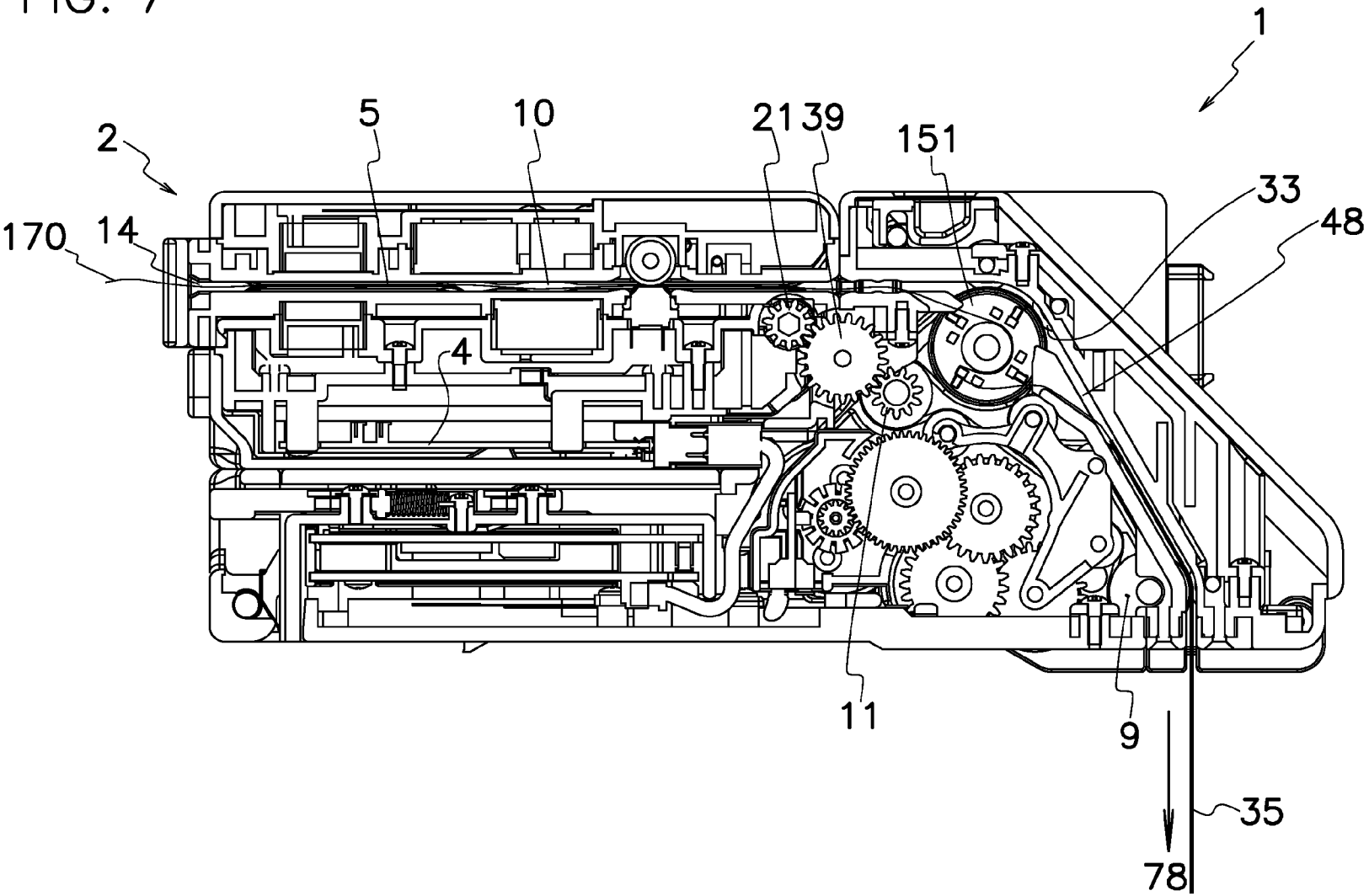
FIG. 7 is a sectional view of the drive device to which a validator is attached in drivingly and separably interlocked relation.

[3] Driving and Disengageable Connection Between Transport Device and Drive Device As is apparent from FIG. 6, a sliding connector 16 is provided between case 15 in drive device 1 and housing 20 in validator 2 to detachably or separably mount housing 20 in validator 2 on case 15 in drive device 1 via sliding connector 16. Sliding connector 16 comprises a pair of rails 52 of L-shaped section secured on case 15, and mating sliders (not shown) secured on a bottom surface of housing 20. These sliders have their cross-section complementary to those of rails 52 to detachably attach sliders to rails 52 for sliding movement of sliders on rails 52 so that validator 2 can move on case 15 along rails 52. When validator 2 moves on case 15 to the innermost and proper fit position, input gear 21 of conveyer device 5 is automatically and disengageably brought into engagement with output gear 39 in drive device 1. Here, as shown in FIG. 7, an outlet of passageway 10 in validator 2 is automatically communicated with inlet 48*a* of intermediate path 48 in drive device 1. When validator 2 moves on rails 52 in the adverse direction away from drive device 1, input gear 21 of conveyer device 5 is automatically disengaged from output gear 39 of drive device 1 to remove validator 2 from drive device 1 while releasing the driving relation between conveyer device 5 and drive device 1. An additional latch device may be provided to prevent contingent separation of validator 2 from drive device 1 under the engaged condition of input gear 21 with output gear 39, and this additional latch device may have a similar structure as that of a latch device shown in FIGS. 26 to 29.

[4] Second Driven Device=Carrier Device

Figure 2:
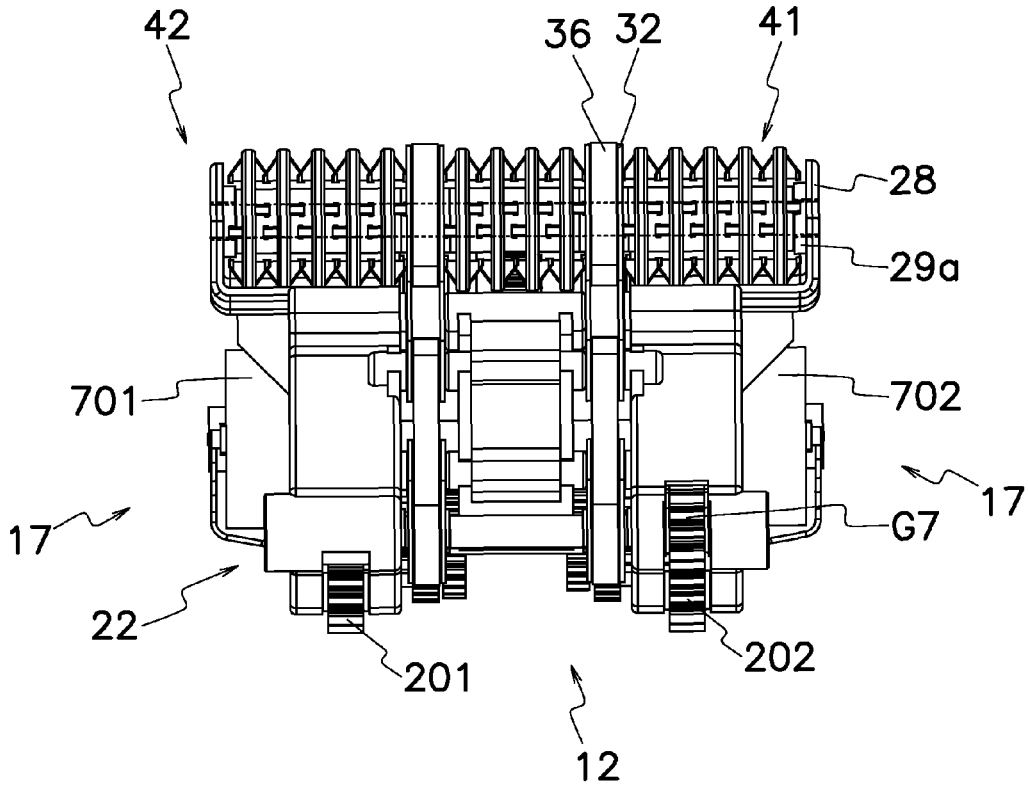
FIG. 2 is a side elevation view of the drive device shown in FIG. 1.

Carrier and pusher devices 6 and 7 in stacker 3 shown in FIGS. 13 and 14 are respectively second and third driven devices which have respectively carrier and pusher gears 761 and 762 (drive gears 76) drivingly and disengageably connected to respectively transport and stowing gears 201 and 202 of posterior gears 12 in drive device 1 (FIG. 2). Carrier device 6 comprises carrier gear 761, an intermediate gear 767 meshed with carrier gear 761, a pulley gear 763 meshed with intermediate gear 767, a pulley 764 rotatable integrally with pulley gear 763, and a belt 765 wound around pulleys 764 and 768 and an idle roller 766. During forward rotation of reversible transport motor 701, transport device 9 in drive device 1 is operated to transport bill 35 through passageway 10 and intermediate path 48 and also rotate carrier gear 761 of carrier device 6. Rotation of transport gear 201 causes carrier gear 761, intermediate gear 767, pulley gear 763 and pulley 764 to rotate so that belt 765 receives bill 35 supplied from outlet 48*b* of intermediate path 48 to transport it into standby chamber 78 in stacker 3. During adverse rotation of transport motor 701, transport device 9 in drive device 1 is rotated in the adverse direction to return bill 35 through intermediate path 48 and passageway 10 to inlet 14.

Pusher device 7 comprises a series of gears 710 to 713 meshed with pusher gear 762, and a link device 717 provided with an arm 715 formed with an opening 716 for receiving a pin 714 secured on gear 713. Operation of stowing motor 702 causes pusher gear 762 to rotate, and therefore, gear 713 together with pin 714 is rotated to retract link device 717 to the backward original position shown in FIG. 14. When bill 35 is sent to standby chamber 78, stowing motor 702 is operated to extend link device 717 from the original position to the stretched position (not shown) to stow bill 35 in standby chamber 78 into storage 79. Further forward rotation or adverse rotation of stowing motor 702 causes link device 717 to be retracted from the stretched position and to return pusher device 7 to the shown original position. U.S. Pat. Nos. 5,836,435 and 5,372,361 disclose a detail of such a pusher device for stowing a bill in standby chamber into a storage, and further detailed description on pusher device 7 is omitted herein.

Figure 18:
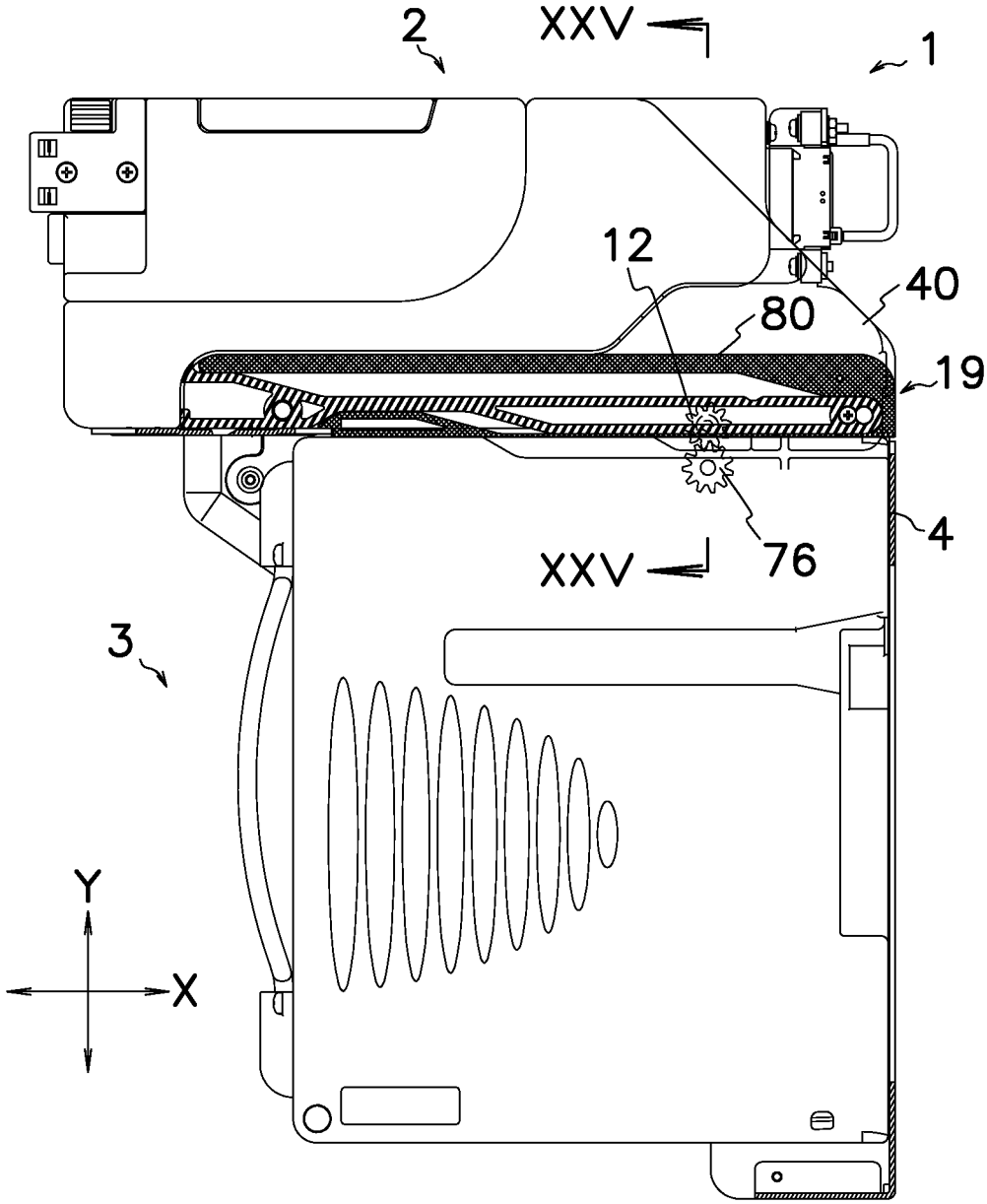
FIG. 18 is a sectional view of a cam connector for attaching the drive device to a frame.

As shown in FIG. 18, drive device 1 may be detachably attached to a frame 4 of the bill handling apparatus through a cam connector 19. In an embodiment shown in FIG. 19, cam connector 19 comprises cam guides 80 (FIG. 20) formed on a pair of vertically disposed side walls 40 in frame 4, and followers 81 formed on a pair of vertically disposed side walls 51 in drive device 1 so that followers 81 may be inserted into mating cam guides 80 for detachable attachment of drive device 1 to frame 4. A bracket 82 is horizontally disposed at a right angle and connected to vertically disposed side walls 40 in frame 4. Cam connector 19 may be formed of molding resin, forming metal or combined material of resin and metal. As shown in FIG. 20, cam guide 80 comprises a distal path 83 horizontally formed on side walls 40 in frame 4, an aslope access path 84 connected to distal path 83, and a horizontal proximal path 85 connected to a bottom of access path 84.

Distal path 83 comprises a distal surface 86 formed opposite to bracket 82, a ridged surface 87 upwardly protruded toward distal surface 86 and an inlet incline 88 formed in front of ridged surface 87. Access path 84 is formed between distal and proximal paths 83 and 85 to comprise a back ramp 89 connected to distal surface 86 and an anterior ramp 90 connected to ridged surface 87 and disposed in parallel to back ramp 89. Proximal path 85 comprises a proximal surface 91 continuously extending from anterior ramp 90 and disposed in parallel to distal surface 86, a latch surface 92 continuously extending from back ramp 89 and disposed in parallel to distal surface 86, and an innermost surface 93 formed between proximal and latch surfaces 91 and 92. Bracket 82 is attached and secured to frame 4 in front of inlet incline 88 to define an inlet 105 of distal path 83 in cooperation with distal surface 86.

Figure 21:
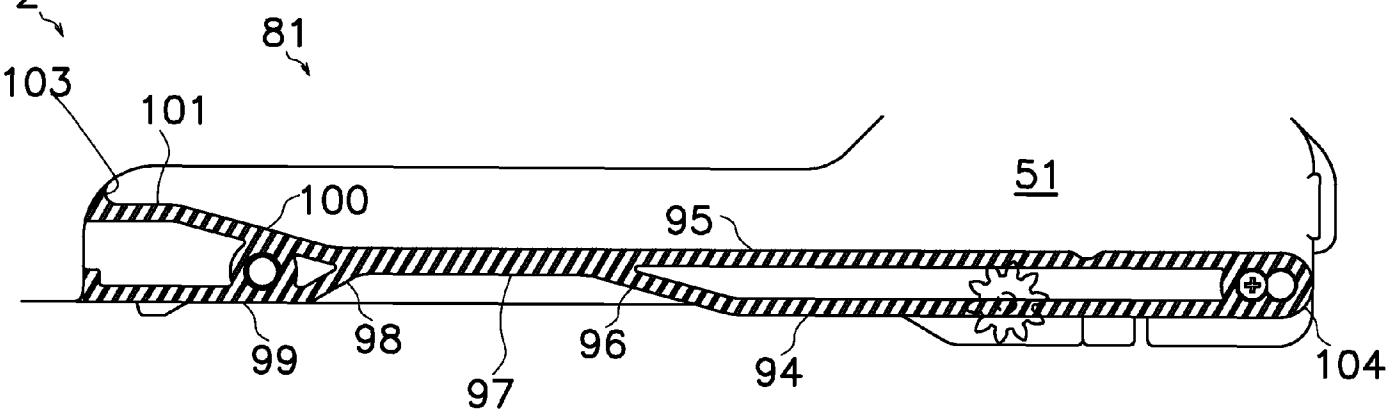
FIG. 21 is a sectional view of a follower in the cam connector.

Follower 81 shown in FIG. 21 comprises a proximal flat 94, a distal flat 95 formed in parallel to and in an upwardly spaced relation to proximal flat 94, an intermediate ramp 96 connected to proximal flat 94 and disposed in parallel to anterior ramp 90, an intermediate flat 97 connected to intermediate ramp 96 and disposed in parallel to and in an upwardly spaced relation to proximal flat 94, a complementary ramp 98 connected to intermediate flat 97, a base flat 99 connected to complementary ramp 98 and disposed in parallel to and in a downwardly spaced relation to intermediate flat 97, a stabilizing ramp 100 connected to distal flat 95 and disposed in parallel to intermediate ramp 96, and an anterior flat 101 connected to stabilizing ramp 100 and disposed in parallel to and in an upwardly spaced relation to distal flat 95, a rising 103 formed at an end of anterior flat 101 to come into contact to or confrontation with an edge 102 of inlet 105 in distal path 83 when follower 81 is inserted into cam guide 80, and an arcuate end surface 104 connecting proximal and distal flats 94 and 95. Arcuate end surface 104 has a complementary arcuate shape to that of innermost surface 93 of proximal path 85.

Figure 22:
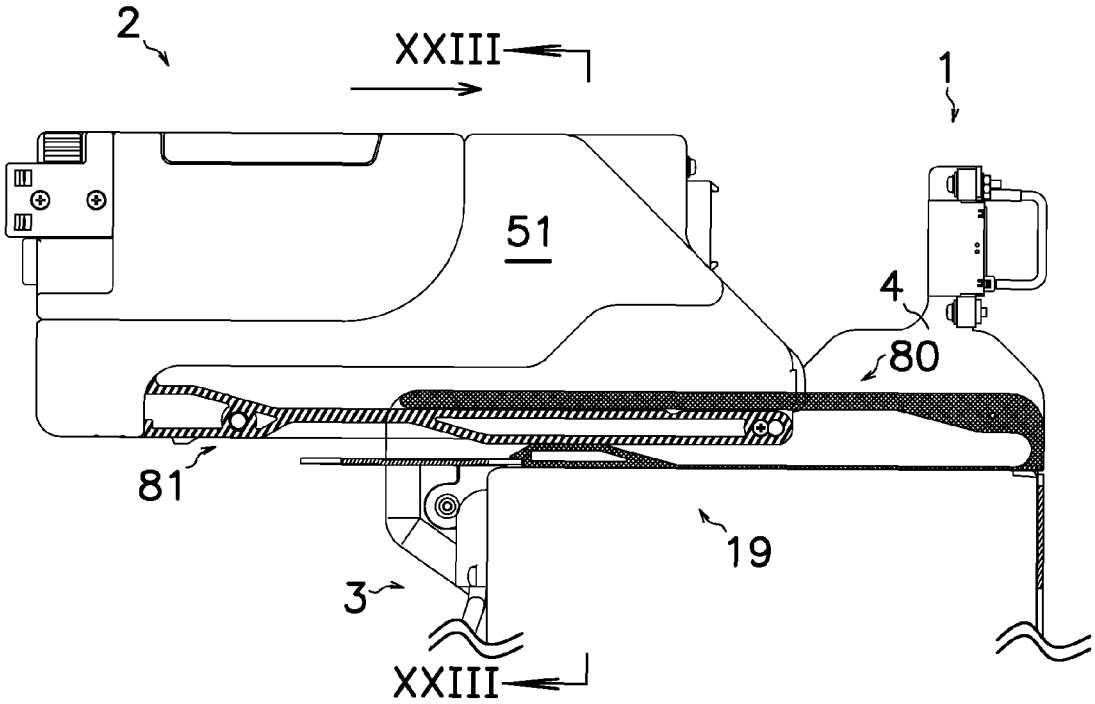
FIG. 22 is a sectional view of the cam connector with the follower inserted into the cam guide.
Figure 23:
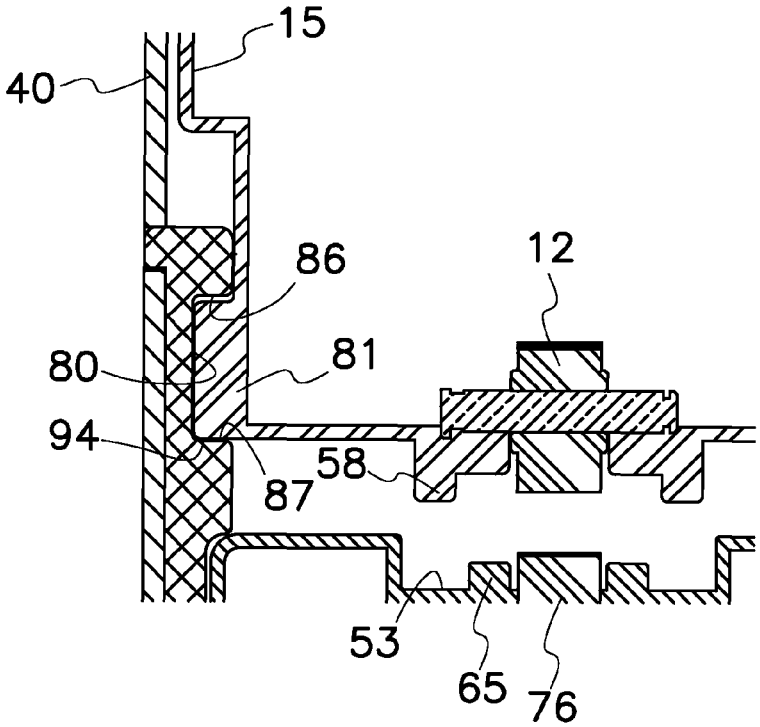
FIG. 23 is a sectional view of a posterior gear in the drive device in a spaced relation to a drive gear in the stacker.

As seen from FIGS. 22 and 23, when follower 81 of drive device 1 is installed in the fixed position of frame 4, end surface 104 of follower 81 is inserted into inlet 105 of distal path 83 and is brought into contact to inlet incline 88 to guide end surface 104 upward along inlet incline 88 onto ridged surface 87. Then, proximal flat 94 of follower 81 is in contact to and slides on ridged surface 87 to simultaneously bring distal flat 95 of follower 81 to face or be in contact to distal surface 86 of distal path 83, and then proximal flat 94 is inwardly moved along and in sliding contact to distal path 83. In other words, follower 81 is traveled toward the rear of frame 4 in an upwardly spaced relation from stacker 3 by a height of ridged surface 87 over bracket 82. Although bottom parts of posterior gears 12 and protective ridges 58 of drive device 1 are located to project from bottom surface 15*a* of case 15, it is possible to prevent unfavorable contact of these bottom parts to bracket 82 and a top surface 62 of stacker 3 while moving follower 81 rearward, because proximal flat 94 of follower 81 is in contact to ridged surface 87 of cam guide 80 to space these bottom parts from bracket 82 and top surface 62 as shown in FIGS. 22 and 23.

Figure 24:
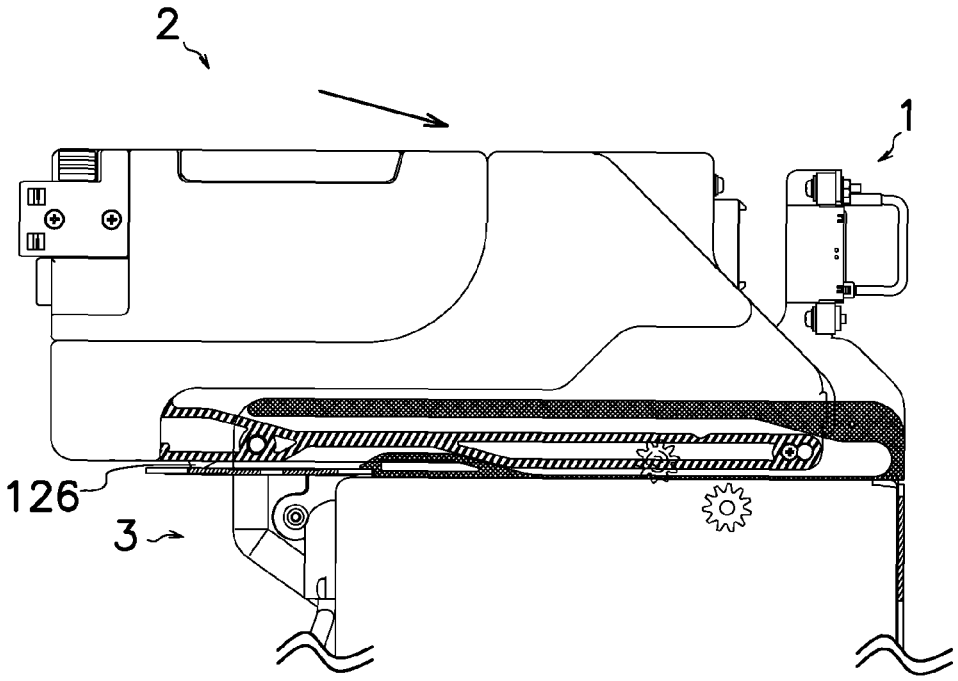
FIG. 24 is a sectional view showing the cam connector with the follower further inserted into the cam guide.

When follower 81 of drive device 1 is further inwardly pushed into the rear of distal path 83 from the position shown in FIG. 22, as illustrated in FIG. 24, end surface 104 of follower 81 comes into contact to back ramp 89 to concurrently put intermediate ramp 96 of follower 81 in touch with and slides on anterior ramp 90 so that the whole of follower 81 and drive device 1 is moved downwardly toward stacker 3 along access path 84 defined by back and anterior ramps 89 and 90 on the angle shown by an oblique arrow in FIG. 24. Immediately when follower 81 reaches proximal path 85, proximal flat 94 of follower 81 is brought into contact to proximal surface 91, and simultaneously, posterior gears 12 and protective ridges 58, projecting from bottom surface 15*a* of case 15, are brought into engagement with respectively carrier and pusher gears 761, 762 and mating inset grooves 53.

Figure 19:
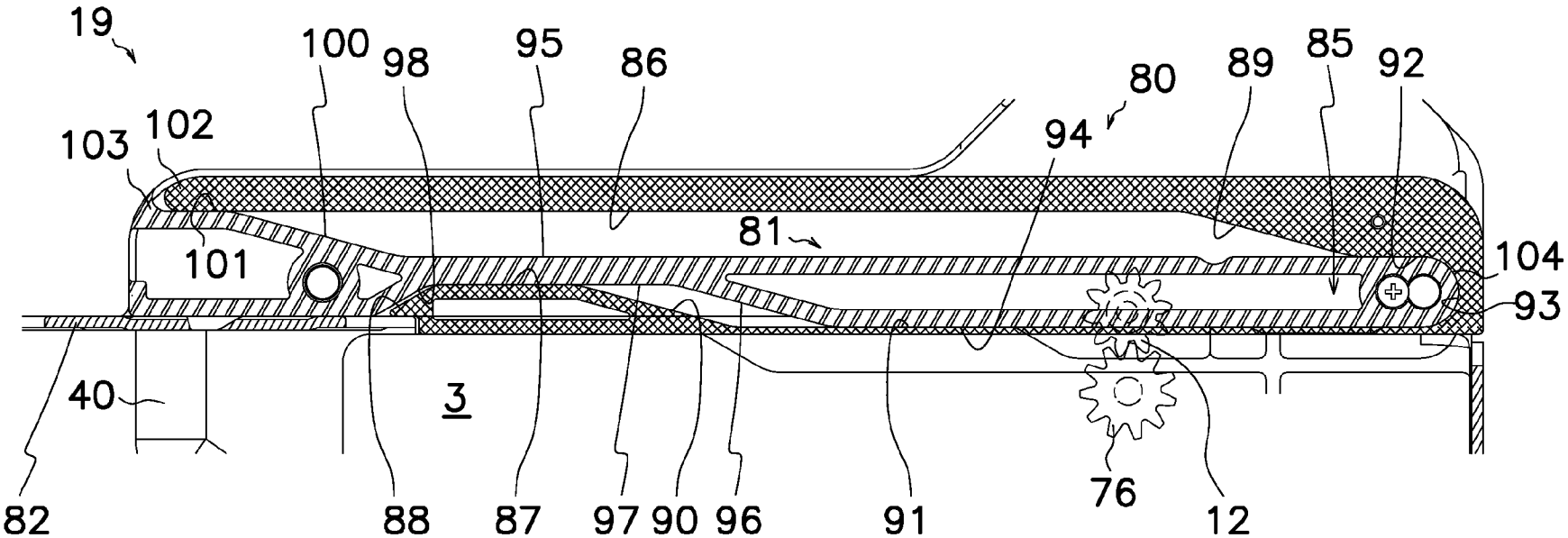
FIG. 19 is an enlarged sectional view of the cam connector.
Figure 20:
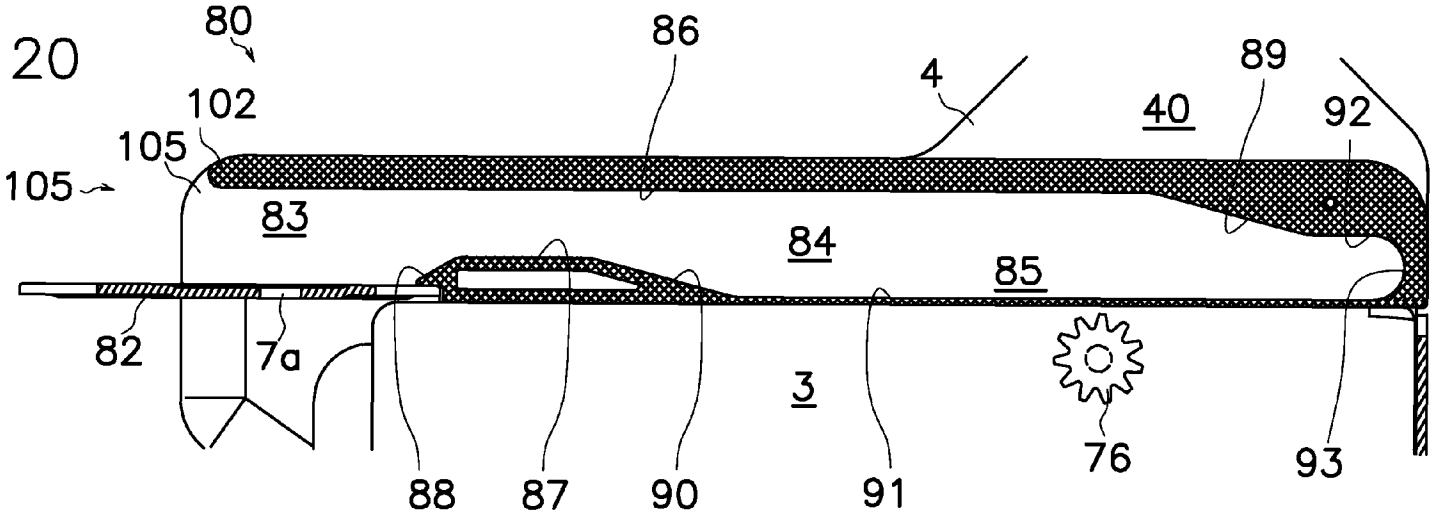
FIG. 20 is a sectional view of a cam guide in the cam connector.
Figure 25:
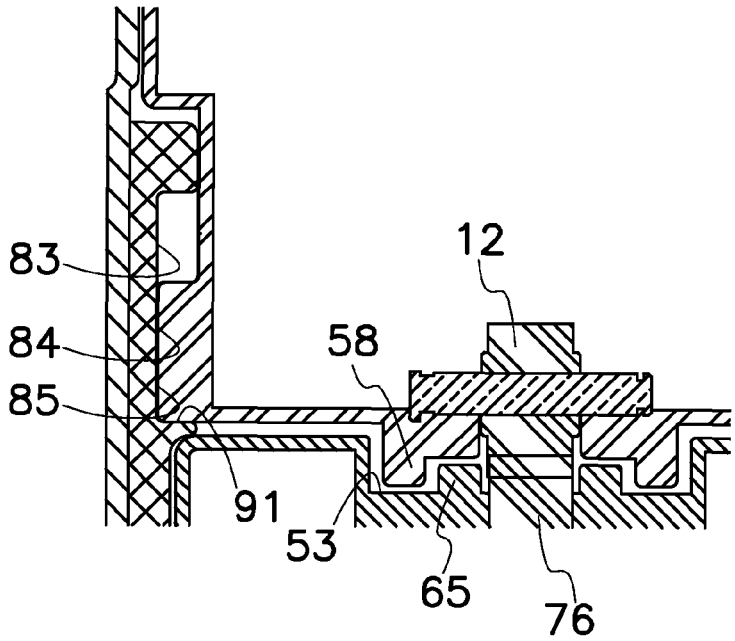
FIG. 25 is a sectional view of the posterior gear in the drive device in an engaged relation to the drive gear in the stacker.
Figure 26:
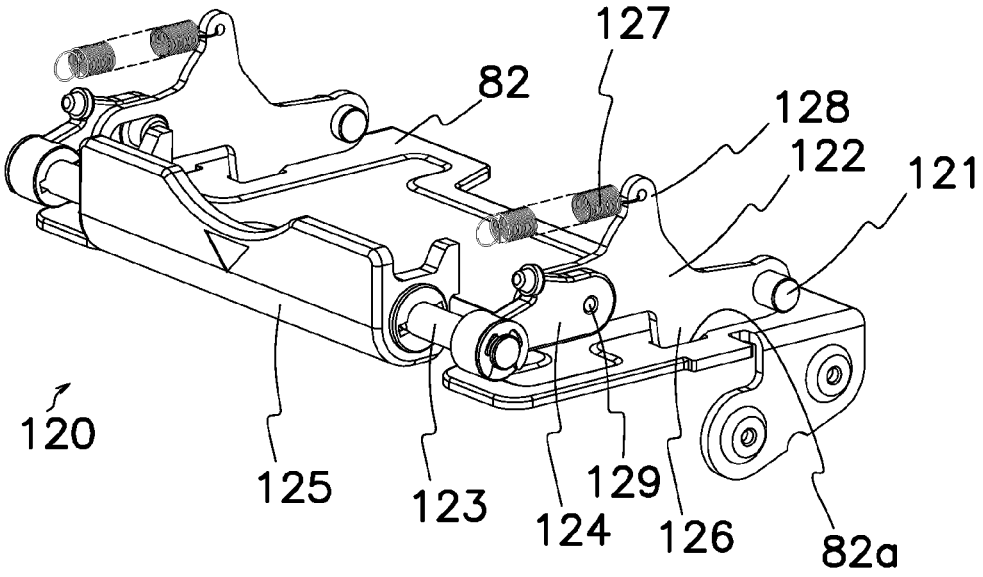
FIG. 26 is a perspective view of a latch device for removably fastening the validator to the frame.
Figure 27:
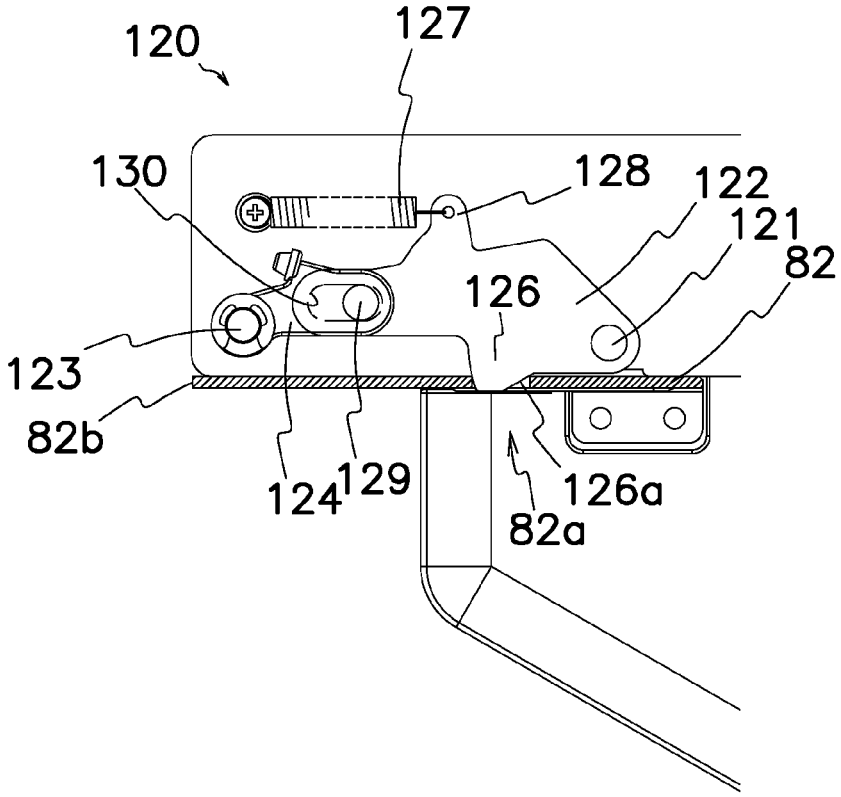
FIG. 27 is a sectional view of the latch device shown in FIG. 26.
Figure 28:
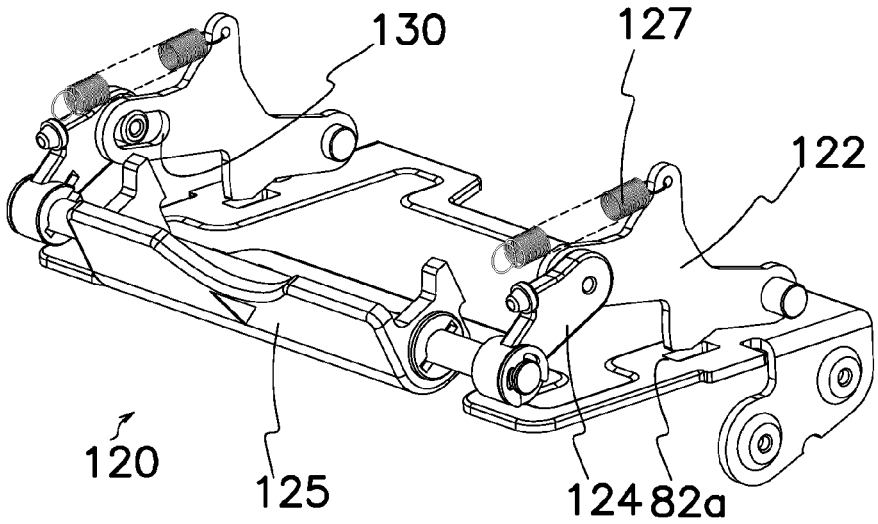
FIG. 28 is a perspective view of the latch device released from a bracket to disengage the validator from the frame.
Figure 29:
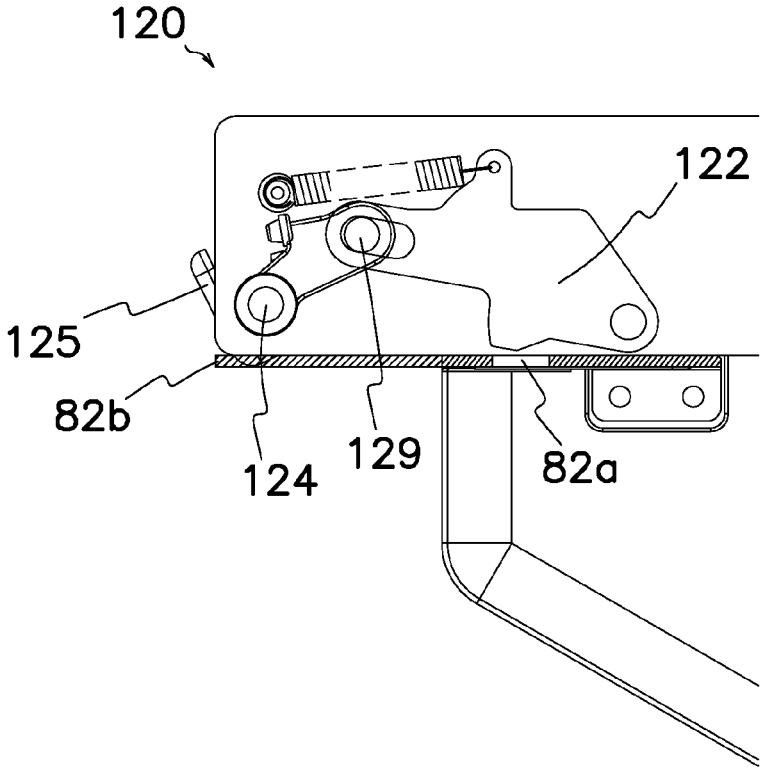
FIG. 29 is a side elevation view of the latch device shown in FIG. 28.
Figure 30:
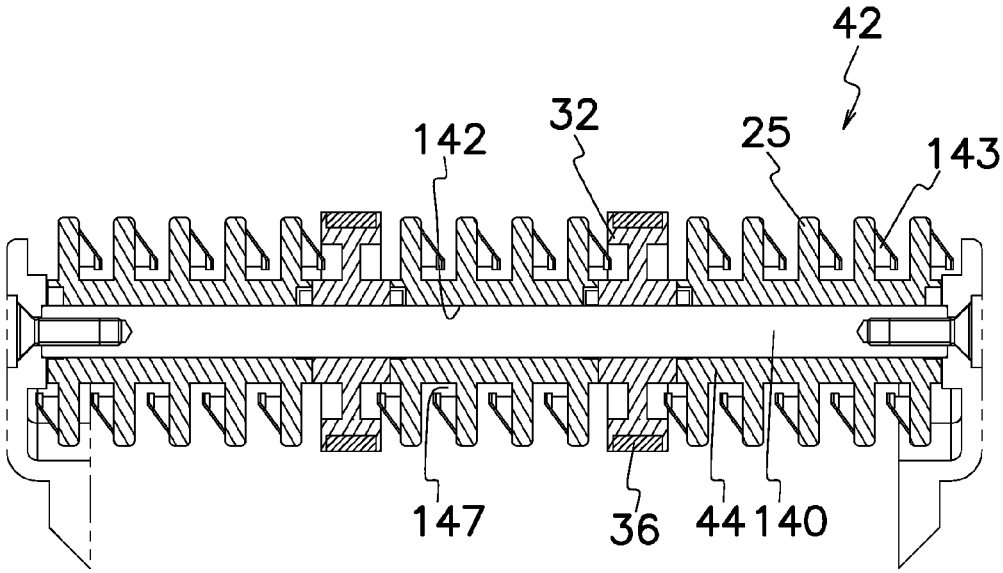
FIG. 30 is a sectional view of a rotor in an anti-pullback unit.

Then, as follower 81 is further pushed toward the rear of proximal path 85, it horizontally moves along proximal path 85 of cam guide 80 by a small distance, and finally end surface 104 of follower 81 comes into contact to innermost surface 93 of proximal path 85 to completely put case 15 in the proper fixed position, at the same time to bring posterior gears 12 into secure engagement with carrier and pusher gears 761, 762 and also to prevent further forward movement of follower 81 as shown in FIGS. 19 and 25. Also, complementary ramp 98 of follower 81 is in contact to or faces inlet incline 88, and rising 103 of follower 81 faces or is in contact to edge 102 of inlet 105, but a gap is formed between intermediate ramp 96 of follower 81 and anterior ramp 90 of cam guide 80 as shown in FIG. 19. Alternatively, posterior gears 12 may be in driving connection with carrier and pusher gears 761, 762 at the time of contact of proximal flat 94 to proximal surface 91 once end surface 104 reaches proximal path 85, and a spring or elastic medium for producing elastic buffer action may be used in at least one of interlocked posterior and carrier and pusher gears 761 and 762.

Figure 16:
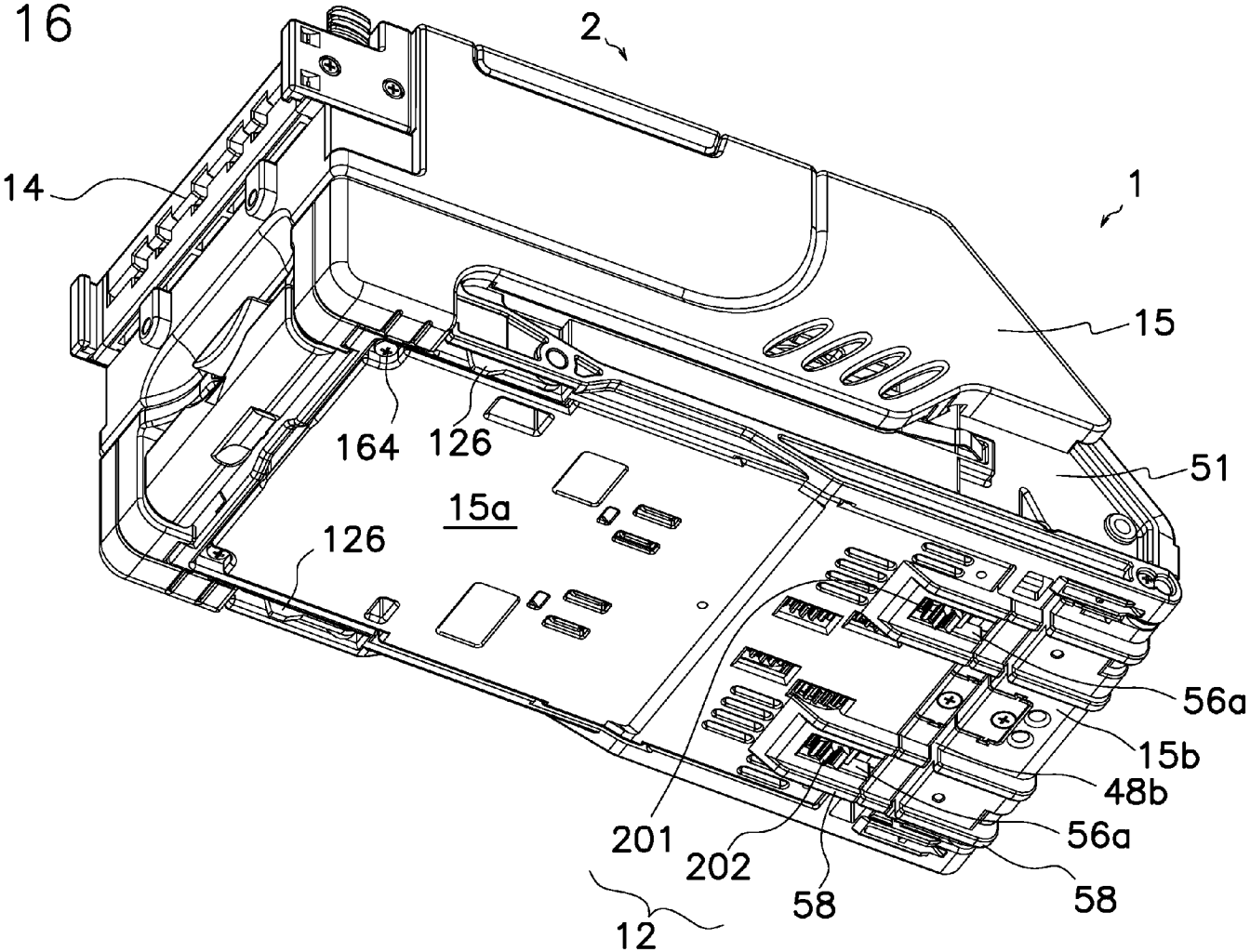
FIG. 16 is a perspective bottom view of the drive device for use in the bill handling apparatus.
Figure 17:
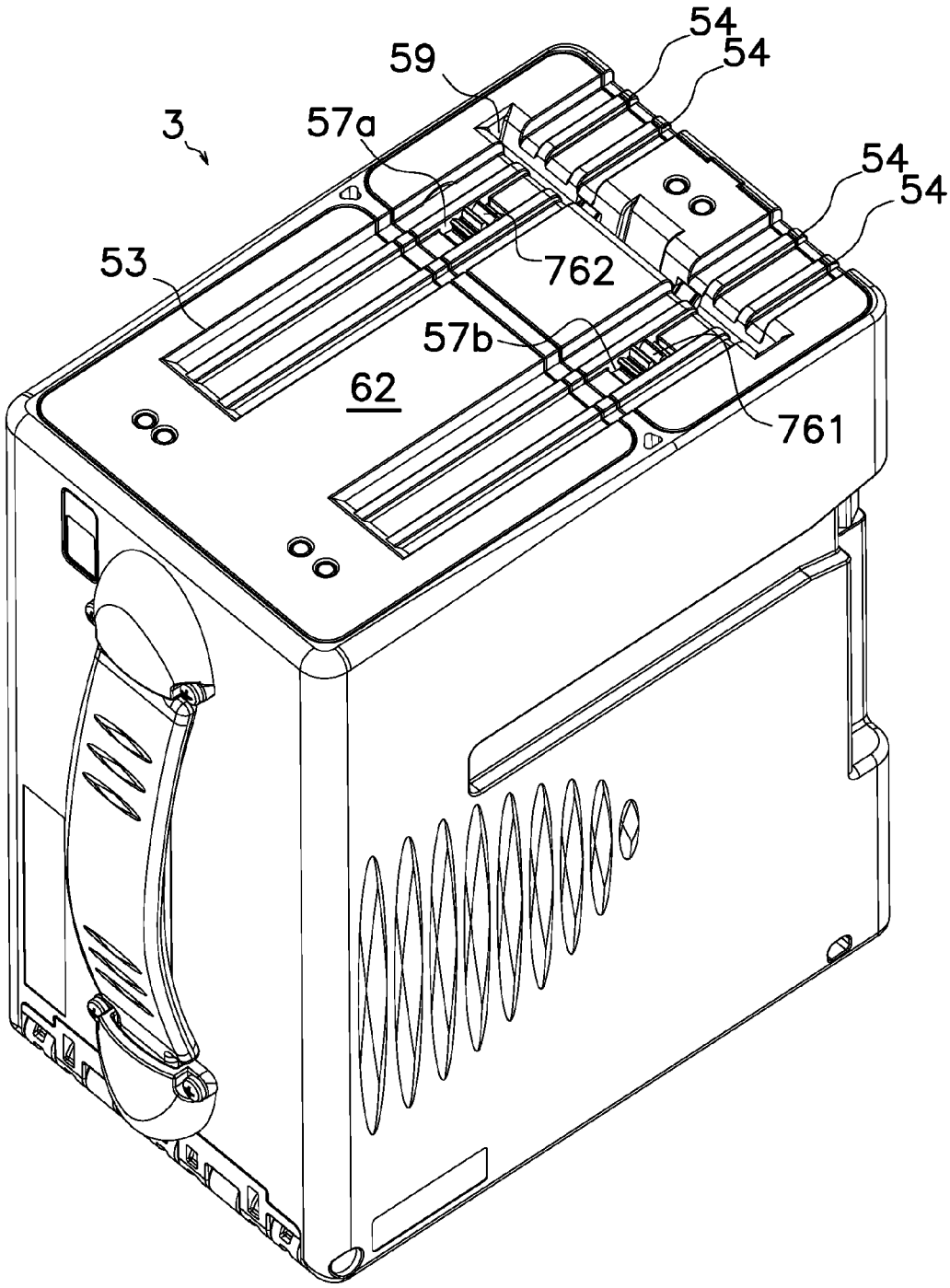
FIG. 17 is a perspective top view of the stacker.

As shown in FIG. 16, bottom surface 15*a* of case 15 is also formed with an outlet 48*b* of intermediate path 48 in drive device 1; transport and stowing gears 201 and 202 of posterior gears 12 of transport device 9 in drive device 1 protrude from openings 56*a*, 56*b* formed on bottom surface 15*a* in case 15; a plurality of protective ridges 58 are formed around openings 56*a*, 56*b* to downward project from bottom surface 15*b* toward stacker 3 while surrounding posterior gears 12. Projection length of protective ridges 58 from bottom surface 15*a* is substantially the same as or more than that of posterior gears 12 to completely surround posterior gears 12 by protective ridges 58. Protective ridges 58 extend in parallel to each other and perpendicularly to outlet 48*b*. As shown in FIG. 17, top surface 62 of stacker 3 is disposed in parallel to bottom surface 15*a* of case 15, and comprises an inlet 59 for receiving bill 35 transported from outlet 48*b* of intermediate path 48 in drive device 1, and a plurality of or four inwardly hollow and straight inset grooves 53 extending lengthwise or perpendicularly to inlet 59 and in parallel to each other. Openings 57*a* and 57*b* are formed in inset grooves 53 to expose carrier and pusher gears 761 and 762 outside through openings 57*a* and 57*b*. A plurality of ridges 54 are formed in inset grooves 53 on top surface 62 and on opposite sides of carrier and pusher gears 761 and 762.

When mounting drive device 1 in the fixed position shown in FIG. 25 on frame 4, bottom surface 15*a* of case 15 comes to be disposed in parallel to top surface 62 of stacker 3; protective ridges 58 of drive device 1 is fit into mating inset grooves 53 of stacker 3; posterior gears 12 of drive device 1 become meshed with carrier and pusher gears 761 and 762 of stacker 3; and at the same time, protective ridges 58 of case 15 are located to sandwich ridges 54 of stacker 3 therebetween; and outlet 48*b* of intermediate path 48 in case 15 is rendered properly aligned with inlet 59 of stacker 3. At least each bottom part of transport and stowing gears 201 and 202 projects in each opening 56*a*, 56*b* to come into driving and disengageable engagement with respectively carrier and pusher gears 761 and 762 of stacker 3. FIGS. 18 and 19 indicate the arrangement of case 15 in the properly fixed position of frame 4 where end surface 104 of follower 81 is in contact to or closest to innermost surface 93 of cam guide 80. There, as seen from FIG. 25, transport and stowing gears 201 and 202 are in engagement with respectively carrier and pusher gears 761 and 762 to drive carrier device 6 for introducing bill 35 and pusher device 7 for stowing bill 35.

During forward rotation of transport motor 701 in actuator 17, transport gear 201 activates carrier device 6 to introduce bill 35 into standby chamber 78, and during adverse rotation of transport motor 701, bill 35 can be returned to inlet 14 through intermediate path 48 and passageway 10. Then, when bill 35 is retained in standby chamber 78, stowing motor 702 is operated to rotate power transmission device 8 and stowing gear 202 of posterior gears 12 to activate pusher device 7 which then stows bill 35 in standby chamber 78 into storage 79.

[5] Latch Device

As shown in FIGS. 26 to 29, disposed at the front end of case 15 and between case 15 and bracket 82 is a latch device 120 that securely fastens case 15 to bracket 82 to prevent contingent movement of case 15 in the withdrawal direction. Latch device 120 comprises a ratchet lever 122 rotatably mounted on bracket 82 around a shaft 121, a rotatable operation lever 124 secured on an axis 123, a handle 125 secured on axis 123 and a tensile spring 127 having one end secured to side wall 51 of case 15 (FIGS. 6 and 27) and the other end connected to a biased end 128 of ratchet lever 122 to produce a tensile elastic force for resiliently urging ratchet lever 122 in the counterclockwise direction of rotation around shaft 121. Ratchet lever 122 comprises a stopper 126 formed with a lever slant 126*a* which may be caught by an edge of an opening 82*a* formed on bracket 82, and an elongated hole 130 for rotatably receiving a pin 129 secured on operation lever 124. When drive device 1 is mounted on frame 4, stopper 126 slides on an upper surface of bracket 82 with lever slant 126*a* in contact to bracket 82, and therefore, lever slant 126*a* forcibly rotates ratchet lever 122 in the clockwise direction against resilient force of tensile spring 127. When handle 125 is manually withdrawn downward, ratchet lever 122 is also forcibly rotated in the clockwise direction to release engagement of stopper 125 from opening 82*a*.

In this embodiment, superficial configurations of inner surfaces in frame 4 and outer surfaces in drive device 1 can be contoured into cam guide 80 and follower 81 of cam connector 9 without need of any additional component or prior art connector between frame 4 and drive device 1, and therefore, the bill handling apparatus may increase height and length in stacker 3 to effectively expand its content for accommodating bills therein. Also, as stacker 3 may have its extended length, it can receive longer bills prior art stackers cannot stow, and obviously this widens application ranges of the bill handling apparatus. Although carrier and pusher gears 761 and 762 of stacker 3 are located within stacker 3 not to project beyond top surface 62 of stacker 3, drive device 1 can be mounted at a predetermined fixed location in frame 4 while protecting transport and stowing gears 201 and 202 of drive device 1 against undesirable collision with externals upon attachment and detachment operation of drive device 1 with respect to frame 4, thereby extending service life of the bill handling apparatus.

When follower 81 is moved along distal path 83 as shown in FIG. 24, lever slant 126*a* of stopper 126 in latch device 120 is brought into contact to an edge 82*b* of bracket 82 (FIG. 27) to forcibly rotate latchet lever 122 in the clockwise direction around shaft 121 against elastic force of spring 127, and therefore, stopper 126 runs on and moves sliding on upper surface of bracket 82. Then, follower 81 is moved down at a slant along back and anterior ramps 89 and 90 through access path 84 during which stopper 126 remains in contact to upper surface of bracket 82. When end surface 104 of follower 81 is brought into contact to innermost surface 93 of proximal path 85, elastic force of spring 127 rotates latchet lever 122 in the counterclockwise direction to engage stopper 126 into opening 82*a* of bracket 82 so that latch device 120 serves to set drive device 1 in the fixed position of frame 4 and to thereby certainly prevent abrupt withdrawal of drive device 1 from frame 4. In this way, cam guides 80 and mating followers 81 provide a slip-on attachment construction for promptly and easily mounting and dismounting drive device 1 on and from frame 4 without producing any mechanical collision therebetween.

When drive device 1 is removed from frame 4, handle 125 is manually rotated downward or in the counterclockwise direction around axis 123 against resilient force of spring 127 to rotate latchet lever 122 upward in the clockwise direction through pin 129. Clockwise rotation of latchet lever 122 releases engagement between stopper 126 and opening 82*a* to allow drive device 1 to be pulled forward so that followers 81 can be separated from cam guides 80 to remove drive device 1 from frame 4 without undesirable physical contact of transport device 9 in drive device 1 to bracket 82 and top surface 62 of stacker 3.

[6] Driving and Separable Connection Between Drive Device and Stacker

According to the bill handling apparatus of the present invention, after follower 81 is inserted into proximal path 85 of cam guide 80, case 15 of drive device 1 is further pushed toward inside of frame 4 as shown in FIG. 24, and so, follower 81 may be horizontally and slightly moved along proximal path 85. When end surface 104 of follower 81 comes into contact to innermost surface 93 of proximal path 85, drive device 1 is brought into the proper fixed position for preventing further inward movement of drive device 1, and at the same time, posterior gears 12 are drivingly connected to drive gears 76. At the same time, complementary ramp 98 of follower 81 is in contact to or faces inlet incline 88; rising 103 of follower 81 faces or is in contact to edge 102 of inlet 105; a gap is formed between intermediate ramp 96 of follower 81 and anterior ramp 90 of cam guide 80 as shown in FIG. 19. Alternatively, posterior gears 12 may be drivingly connected to drive gears 76 at the time of arrival of follower 81 at proximal path 85 with proximal flat 94 in contact to proximal surface 91. Also, an elastic damper action may be produced by resiliently urging at least one of posterior and drive gears 12 and 76 with an elastic material such as a spring when posterior gears 12 are brought into driving engagement with drive gears 76.

In this way, when drive device 1 is attached to frame 4, follower 81 may be moved along distal path 83 so that drive device 1 may be moved horizontally, parallel to and over top surface 62 of stacker 3 while maintaining drive device 1 in a spaced relation to bracket 82 and stacker 3 to avoid physical contact of posterior gears 12 of drive device 1 to bracket 82 or stacker 3. Then, follower 81 may be moved at a slant along access path 84 increasingly closer to stacker 3 and proximal path 85. When follower 81 reaches proximal path 85 or when follower 81 is slightly moved along proximal path 85 to the fixed position, posterior gears 12 of drive device 1 may be brought into direct engagement with drive gears 76 of stacker 3; at once, proximal flat 94 of follower 81 is brought into contact to proximal surface 91 of cam guide 80; protective ridges 58 on bottom surface 15*a* of drive device 1 may be fit in inset grooves 53 on top surface 62 of stacker 3; and outlet 48*b* of drive device 1 may be in alignment with inlet 59 of stacker 3. The shown embodiment illustrates a structure of cam connector 19 having cam guides 80 formed on inner surfaces of side walls 40 in frame 4 and followers 81 formed on a pair of side walls 51 on case 15 of drive device 1, otherwise, vice versa, followers 81 may be formed on inner surfaces of side walls 40 in frame 4, and cam guides 80 may be formed on a pair of side walls 51 of drive device 1.

[7] Fourth Driven Device=Transport Device

Figure 3:
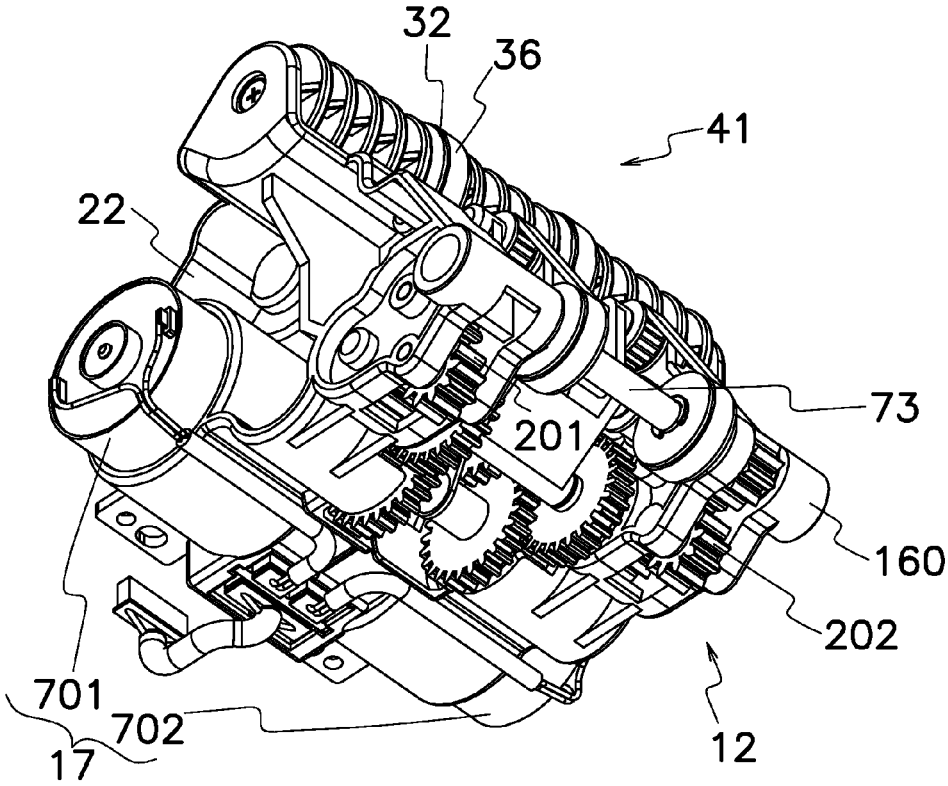
FIG. 3 is a perspective front-bottom view of the drive device.
Figure 4:
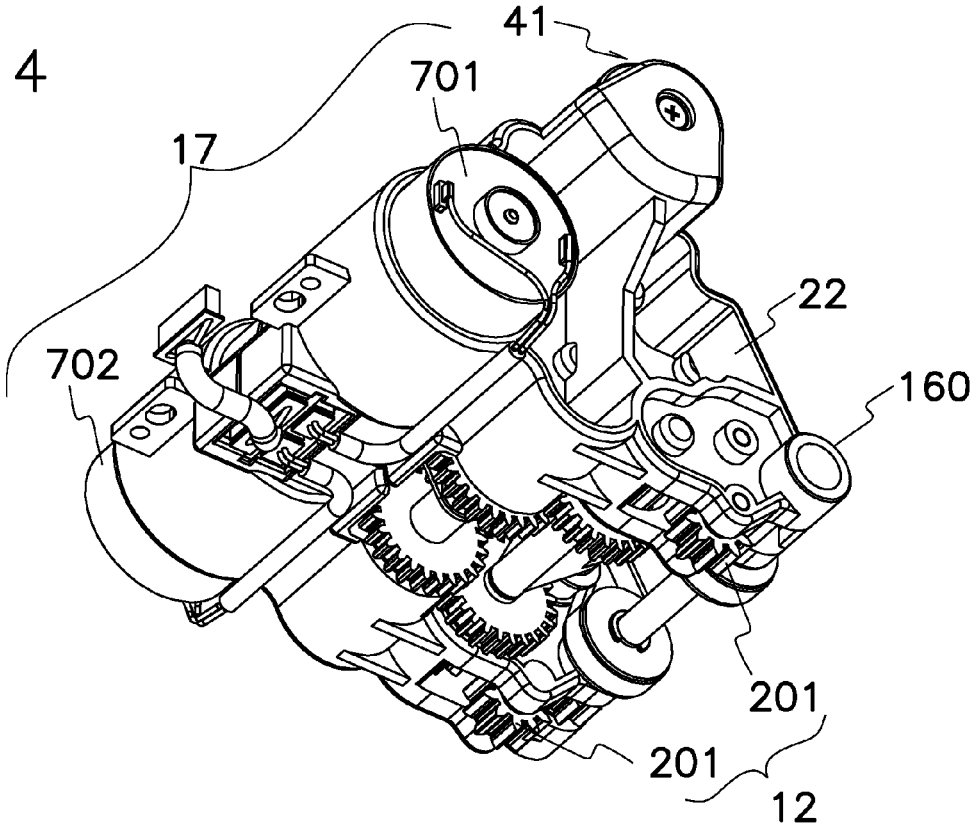
FIG. 4 is a perspective back-bottom view of the drive device.

As shown in FIGS. 2 and 3, transport device 9 comprises a drive pulley 32 drivingly connected to actuator 17 through power transmission device 8 for rotating whole anti-pullback unit 41, a drive belt 36 wound around drive pulley 32, idle rollers 38 and first pulley 74 in drive device 1 for transporting document or bill 35 along intermediate path 48. Bill 35 is fed through passageway 10 in validator 2 into intermediate path 48 of drive device 1, and so, is grasped between drive belt 36 and rotatable pinch rollers 33 to transport bill 35 along intermediate path 48 toward stacker 3.

[8] Fifth Driven Device=Anti-Pullback Unit

As shown in FIGS. 1 to 3 and 30, anti-pullback unit 41 has a rotor 42 that comprises a bearing shaft 140 held on support frame 22, rotor pulleys 32 mounted on bearing shaft 140 for rotation by drive belts 36 wound around rotor pulleys 32, and rollers 43 rotatably mounted on bearing shaft 140 disposed in a bore 142 of rollers 43.

Figure 31:
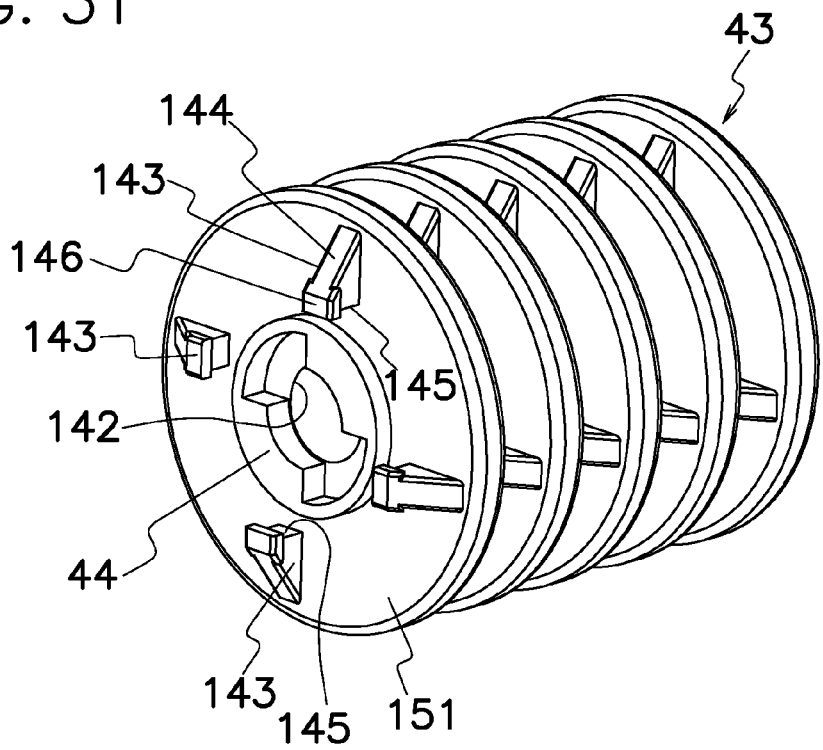
FIG. 31 is a perspective view of a roller in the anti-pullback unit.

As shown in FIG. 31, roller 43 comprises a cylindrical core 44 and a plurality of flange-like disks 151 secured on and radially extending from cylindrical core 44 coaxially, in a line and in a spaced relation each other. Each disk 151 has opposite side surfaces formed with fins 143 that axially project toward a faced radial surface 152 of adjoining disk 151 in a spaced relation to former disk 151. Each fin 143 has a radially outwardly tapered guide surface 144, a barb 145 formed at a radially inward edge of fin 143 and a hook 146 formed at a tip of fin 143 included between guide surface 144 and barb 145 to form each fin 143 into a generally fletched or right-triangular shape.

Figure 32:
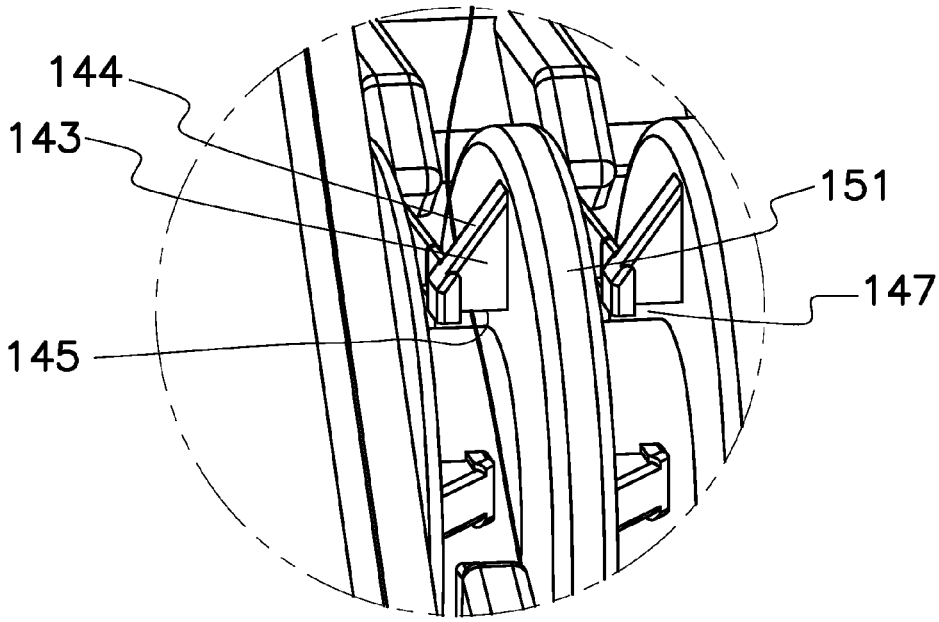
FIG. 32 is a partial perspective view of the anti-pullback unit with fins in the roller with which an extracting string is tangled.

As shown in FIG. 32, hook 146 is formed at the tip of fin 143 to circumferentially or widthwise and radially inwardly slightly project from fin 143 to contour a capture space 147 between barb 145 and cylindrical core 44 so that capture space 147 can catch flexible extracting tool 170 such as thread, string or tape connected to bill 35 to positively prevent unauthorized drawing of bill 35 out of the apparatus.

Pulley 74 shown in FIG. 1 is rotated by transport motor 701 of actuator 17 through power transmission device 8, and drive belts 36 wound around pulleys 74 run to rotate rotor pulleys 32 integrally with anti-pullback unit 41. When bill 35 is sent from passageway 10 into intermediate path 48, it is grasped between drive belts 36 and pinch rollers 33 and transported along intermediate path 48 while bill 35 is in contact to and along outer periphery of disks 151 in roller 43. Then, drive belts 36 are further operated to convey bill 35 along intermediate path 48 toward stacker 3.

[9] Attachment of Drive Unit

Figure 8:
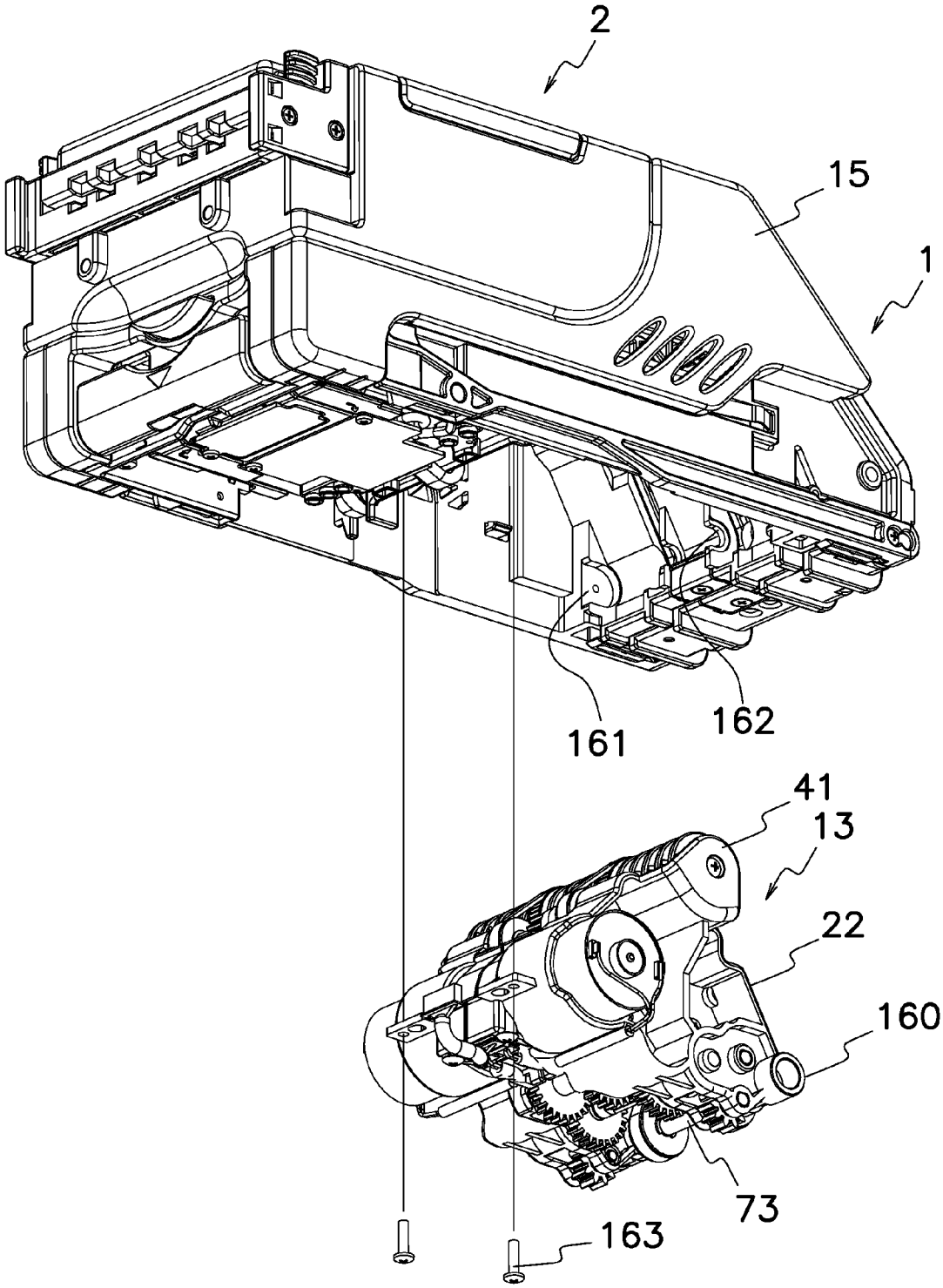
FIG. 8 is a perspective bottom view of the drive device from which a drive unit is removed.
Figure 9:
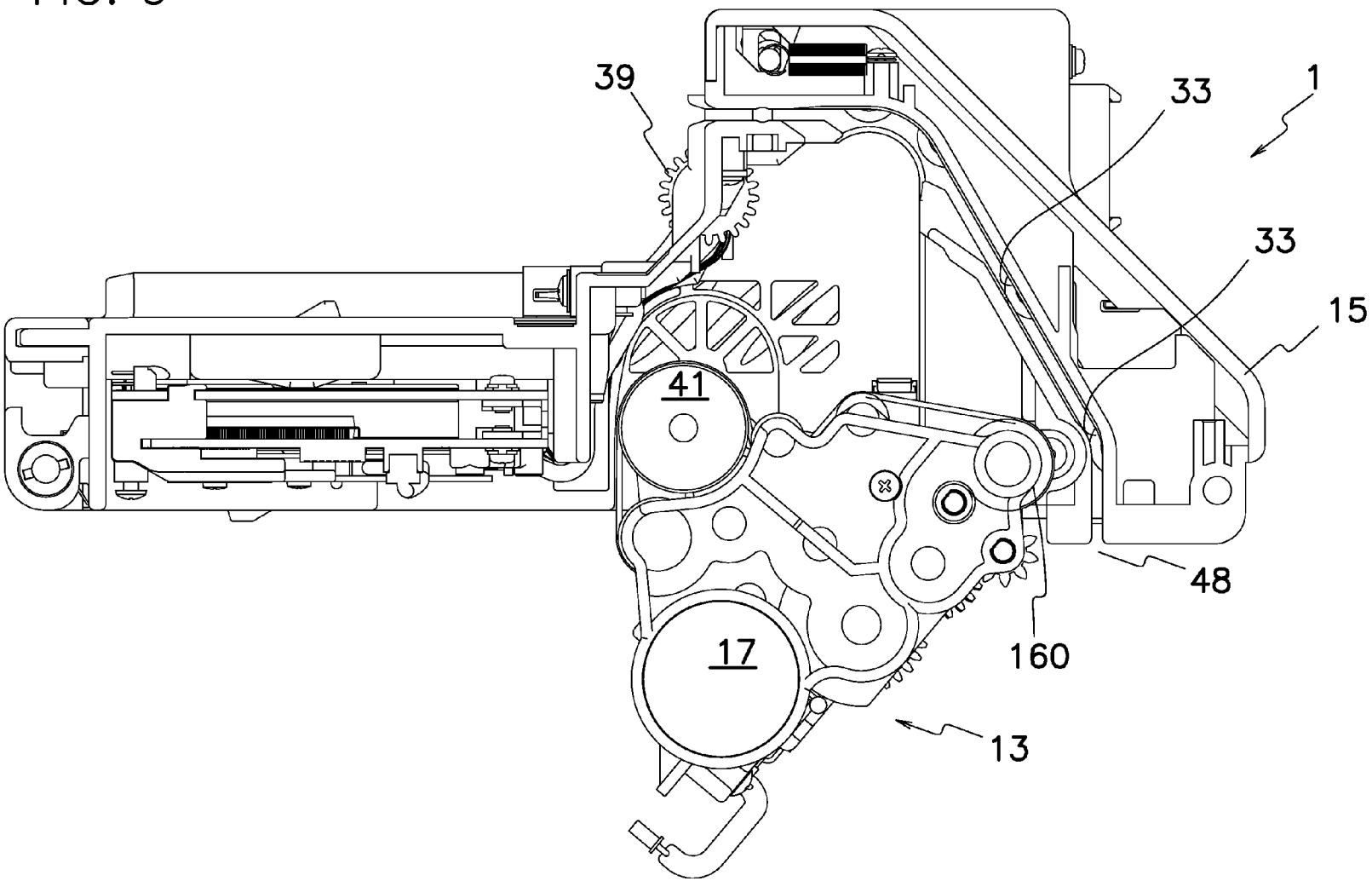
FIG. 9 is a sectional view of the drive device in which the drive unit is mounted on mating bearings with a case.
Figure 10:
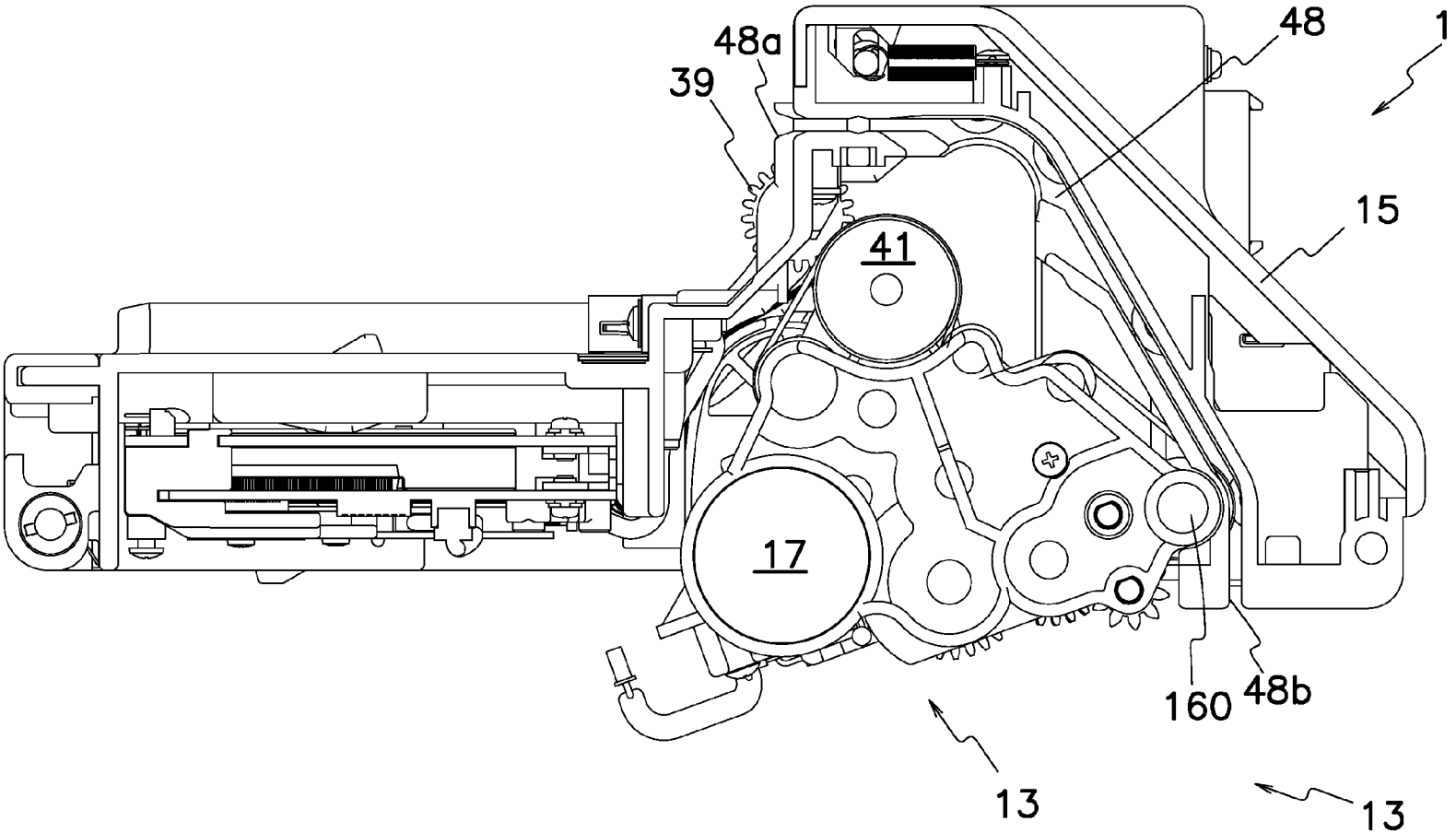
FIG. 10 is a sectional view of the drive device with the drive unit further rotated within the case shown in FIG. 9.
Figure 11:
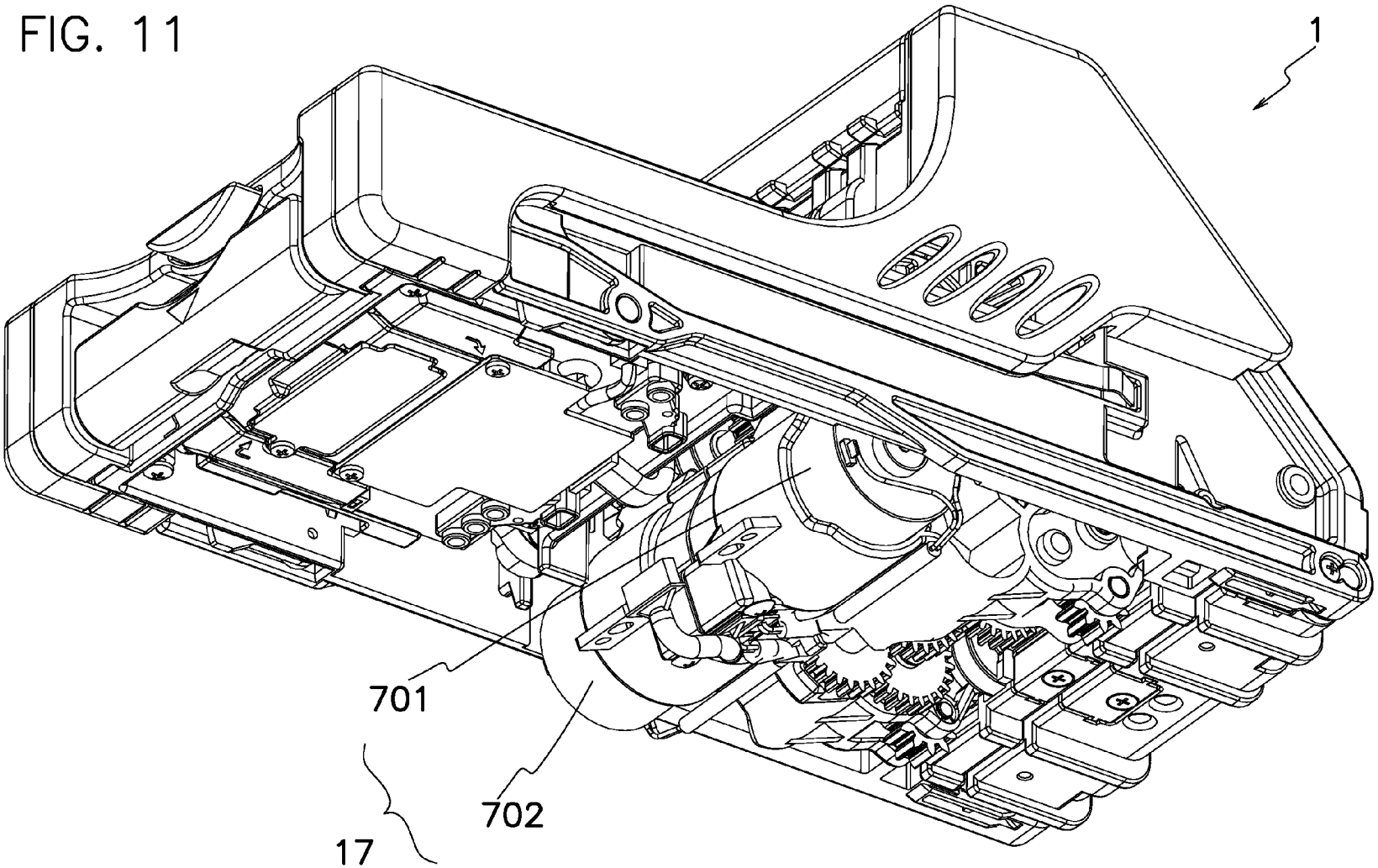
FIG. 11 is a perspective bottom view of the drive device shown in FIG. 10.
Figure 12:
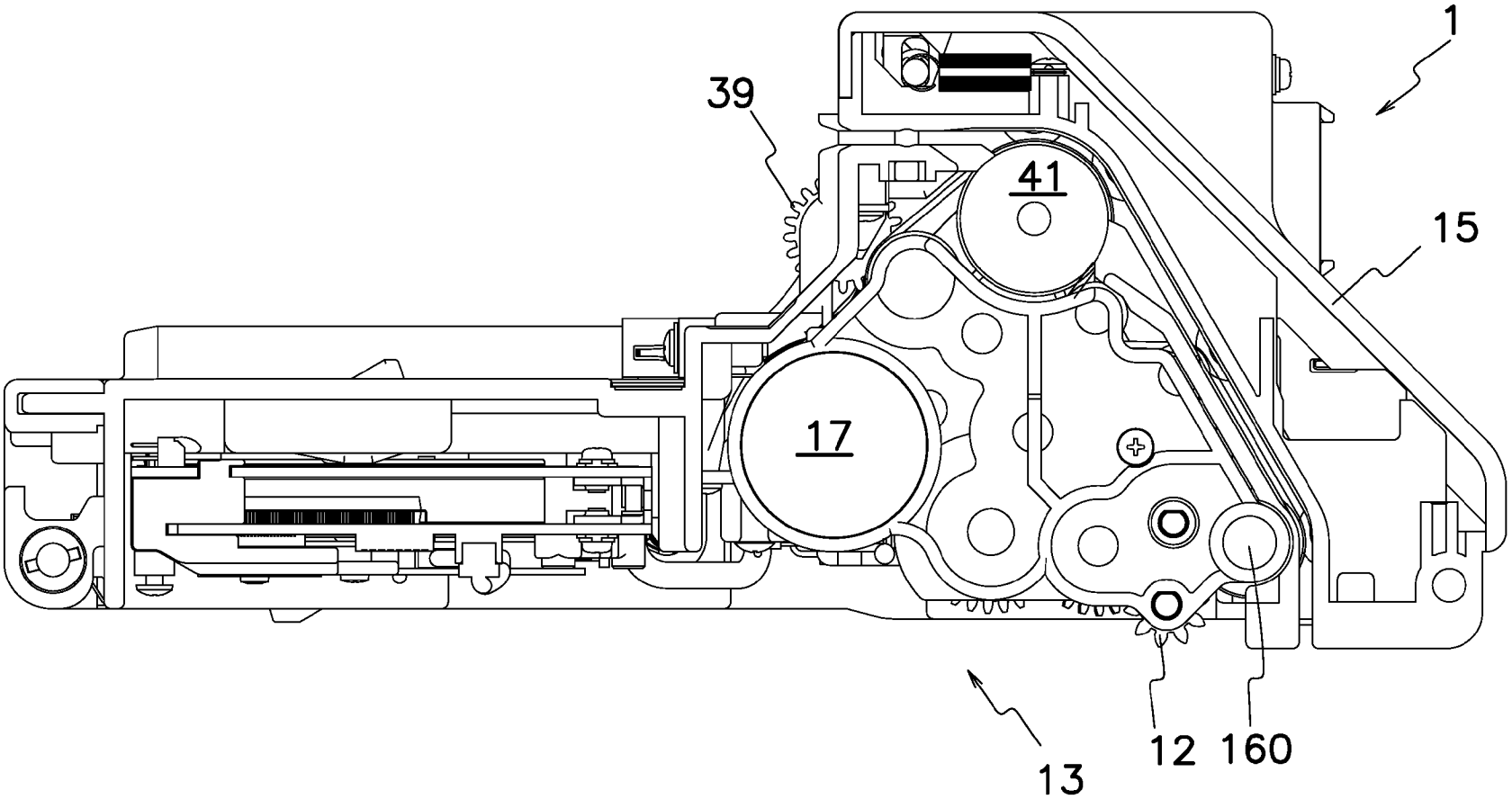
FIG. 12 is a sectional view of the drive device with the drive unit completely stored within the case.

As shown in FIGS. 8 through 12, drive unit 13 of generally triangular section may be easily mounted in and dismounted from case 15 although drive unit 13 comprises as a unit inclusive of actuator 17, power transmission device 8 driven by actuator 17, transport device 9 as a fourth driven device, anti-pullback unit 41 as a fifth driven device and support frame 22 for sustaining all these elements to naturally operate transport device 9 and anti-pullback unit 41 through power transmission device 8. As shown in FIG. 8, support frame 22 comprises a pair of cylindrical or semi-cylindrical hinge sleeves 160 that each have a bearing (not shown) for rotatably supporting hinge shaft 73 in power transmission device 8. Hinge sleeves 160 may be rotatably and removably received by hinge bearings or dents 161 of mating semicircular section formed in case 15, and hinge shaft 73 may be rotatably and disengageably received by a notch 163 formed in case 15. When drive unit 13 is mounted within case 15, firstly, hinge sleeves 160 of drive unit 13 are fit in mating hinge bearings 161; secondly, drive unit 13 is rotated in the clockwise direction around hinge sleeves 160 to a predetermined position in case 15 as seen in FIGS. 9 to 12; and finally, fixation screws 163 are used to fasten support frame 22 to an inner wall of case 15 to secure drive unit 13 in position within case 15. When drive unit 13 is fixed in the proper position within case 15, rotor 42 of anti-pullback unit 41 and drive belts 36 wound around rotor pulleys 32 are correctly positioned facing arcuate intermediate path 48, and simultaneously, anterior gears 11 are automatically and disengageably brought into engagement with output gears 39. A bottom cover 15*a* may be attached to bottom surface of case 15 by means of cap screws 164.

Figure 15:
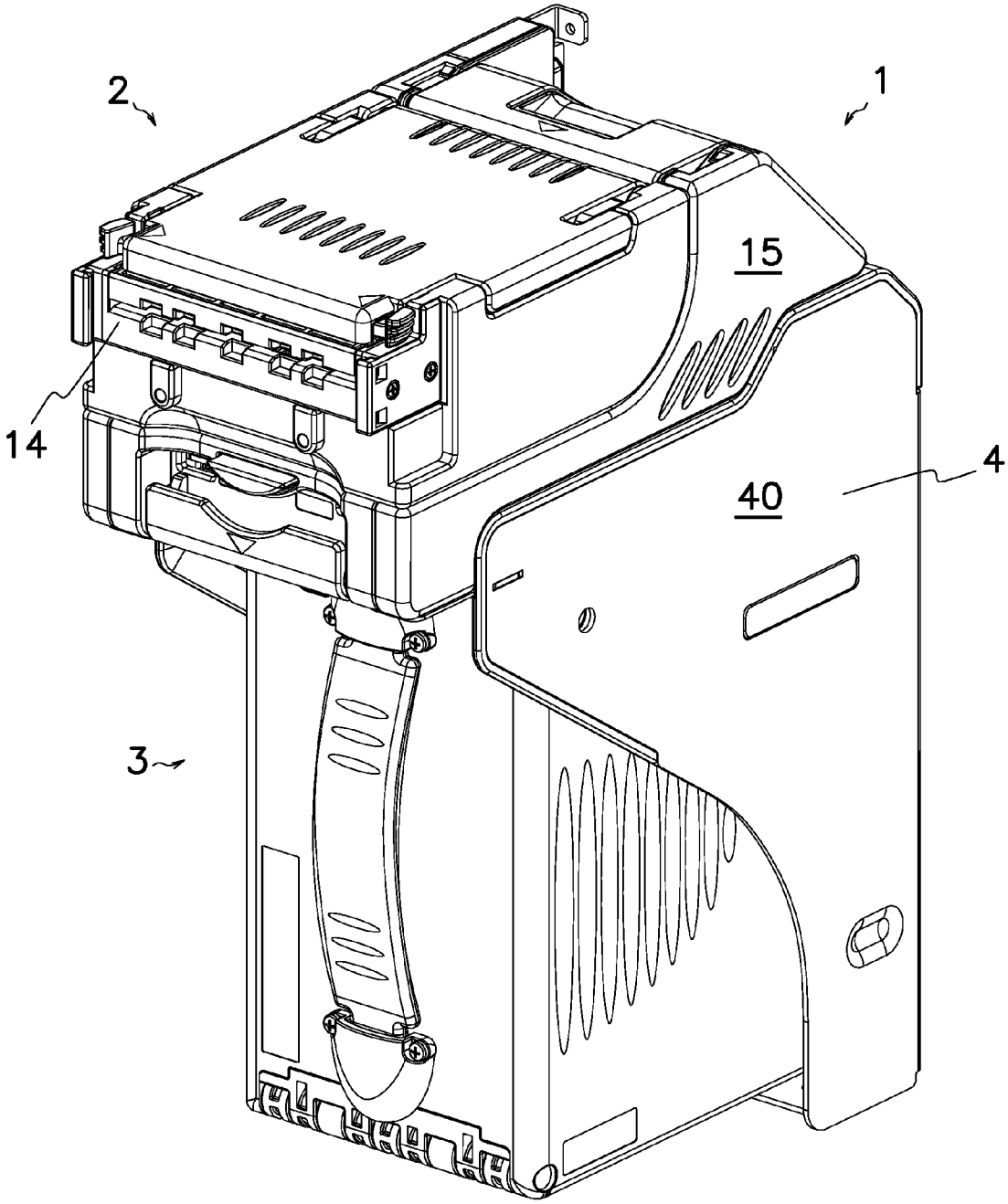
FIG. 15 is a perspective view of the whole bill handling apparatus according to the present invention.

FIG. 15 illustrates a perspective view of the completely assembled bill handling apparatus according to the embodiment of the present invention; FIG. 6 represents an exploded perspective view of frame 4, drive device 1, validator 2 and stacker 3 before assemblage; and FIG. 8 depicts drive unit 13 and case 15 before assemblage. In assemblage, firstly, drive unit 13 is mounted in the proper position within case 15 as described before; secondly, drive unit 13 is secured within case 15 by means of fixation screws 163; and thirdly, bottom cover 15*a* is attached to bottom surface of case 15 by cap screws 164.

Then, fourthly, housing 20 of validator 2 is removably attached on case 15 of drive device 1 by means of sliding connector 16; fifthly, case 15 of drive device 1 is detachably attached to frame 4 by means of cam connector 19; and finally, stacker 3 is detachably attached to frame 4. Adversely, after stacker 3 is attached to frame 4, case 15 may be attached to frame 4 by means of cam connector 19. When case 15 of drive device 1 is attached to frame 4, latchet lever 122 of latch device 120 is automatically locked in opening 82*a* of bracket 82 to prevent accidental pullout of case 15 from frame 4. There is neither priority order nor particular sequence for assembling drive device 1, validator 2, stacker 3 and frame 4, and any optional order may be adopted for assembly and disassembly. By way of example, firstly, housing 20 of validator 2 may be detachably attached on case 15 of drive device 1 through sliding connector 16 to automatically engage input gear 21 of conveyer device 5 with output gear 39 in drive device 1 so that conveyer device 5 may be drivingly and separably connected to drive device 1, and concurrently passageway 10 of validator 2 may automatically be communicated with intermediate path 48 in drive device 1.

Also, proper attachment of follower 81 to cam guide 80 in cam connector 19 ensures at a time firstly the detachable attachment of case 15 of drive device 1 to frame 4 without undesirable contact of transport device 9 to bracket 82 of frame 4 and stacker 3 upon attachment of case 15 to frame 4; secondly the driving, detachable and automatic engagement of posterior gears 12 in drive device 1 with drive gears 76 in stacker 3; thirdly the separable alignment of outlet 48*b* in drive device 1 with inlet 59 in stacker 3; and finally the separable fitting of protective ridges 58 in drive device 1 in inset grooves 53 on top surface 62 in stacker 3. In this case, if drive device 1 is removably attached to frame 4 via cam connector 19 after stacker 3 is detachably attached to frame 4 ahead, or if vice versa, stacker 3 is detachably attached to frame 4 after drive device 1 is removably attached to frame 4 via cam connector 19 ahead, drive device 1 and stacker 3 may be drivingly connected while intermediate path 48 being communicated with standby chamber 78. In this way, one can easily handle, assemble or disassemble drive device 1, validator 2, stacker 3 and frame 4 as discrete individual modules or units. FIG. 15 illustrates a completely assembled bill handling apparatus according to the present invention.

[10] Usage of Bill Handling Apparatus

When bill 35 is inserted into inlet 49 of validator 2 in the assembled bill handling apparatus, an optical inlet sensor detects insertion of bill 35 into inlet 49 to produce a detection signal to a drive control device in case 15 that therefore emits drive signals to rotate transport motor 701 in the forward direction. Driving power of transport motor 701 is transmitted to input gear 21 through power transmission device 8, anterior gear 11 and output gear 39 to operate conveyer device 5, and simultaneously drive belt 36 in transport device 9 runs through power transmission device 8 to carry bill 35 along passageway 10 toward drive device 1. Now, drive power of actuator 7 is transmitted to carrier device 6 in stacker 3 through transport gear 201 and carrier gear 761 in stacker 3 to concurrently operate carrier device 6. Then, validator sensor not shown detects optical and magnetic features of bill 35 moved along passageway 10 to produce detection signals indicative of these features that are received by drive control device for determination on bill authenticity. When drive control device decides bill 35 as genuine, it continuously operate conveyer device 5 in the forward direction to send bill 35 to drive device 1. When drive control device decides bill 35 as false, it rotates transport motor 701 in the adverse direction to reverse power transmission device 8, drive belt 36 in transport device 9 and conveyer device 5 to return bill 35 to inlet 49 of validator 2.

Bill 35 decided as genuine is transported through passageway 10 into intermediate path 48 in drive device 1, and so, it is held between drive belt 36 and pinch rollers 33 to move bill 35 in the forward direction along intermediate path 48 toward stacker 3. Then, bill 35 goes through outlet 48*b* of intermediate path 48 and inlet 59 of stacker 3 into standby chamber 78 by operation of carrier device 6, and there, drive control device stops operation of transport motor 701 and carrier device 6, and at the same time, operates stowing motor 702 to activate pusher device 7 that consequently stows bill 35 in standby chamber 78 into storage 79.

Figure 33:
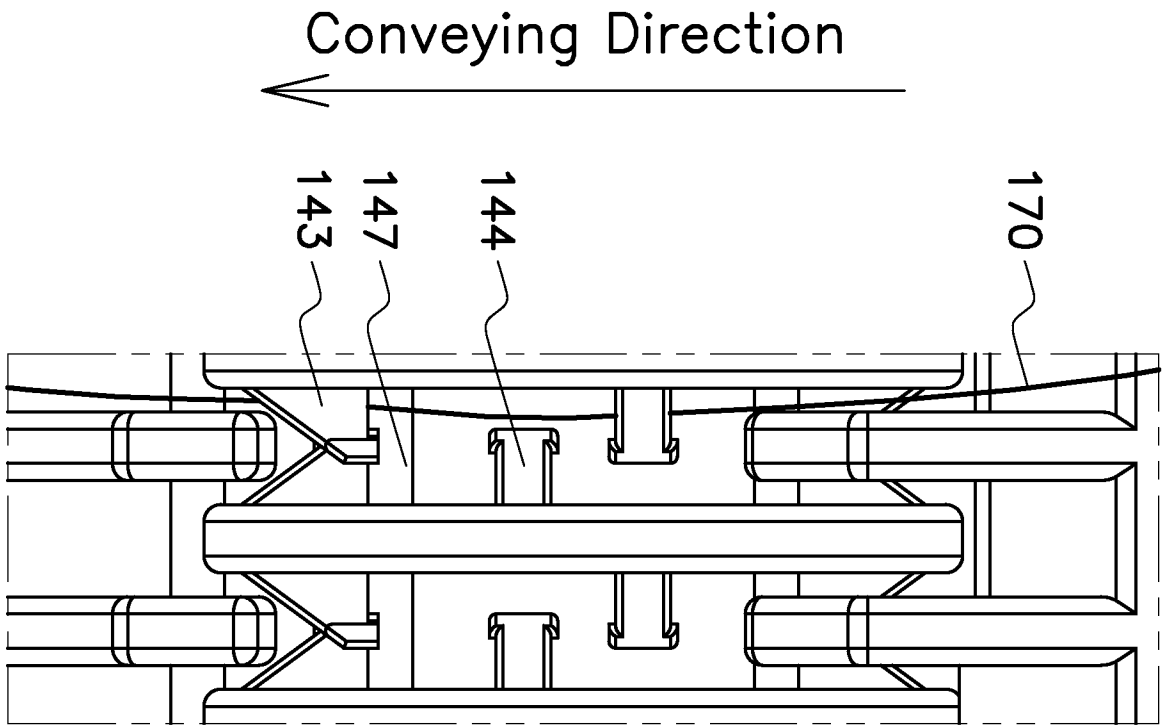
FIG. 33 is a partial front view of the anti-pullback unit shown in FIG. 32.

There may be an undesired case that for the purpose of pulling bill out of the bill handling apparatus without authorization, someone inserts into inlet 14 of validator 2 bill 35 to which some extracting tool 170 such as thread, string or tape is connected. However, anti-pullback unit 41 may certainly prevent such an unfair action as follows. When bill 35 has passed anti-pullback unit 41 as genuine one, forward movement of bill 35 pulls connected string 170 into passageway 10 and intermediate path 48 so that string 170 goes along guide surface 144 of fin 143 in the radially inward direction of roller 43 and comes into engagement with barb 145 of fin 143. In this case, flexible string 170 through passageway 10 and arcuate intermediate path 48 is subject to tensional force by bill 35 transported by transport and carrier devices 9 and 6 possibly in addition to gravities of bill 35 and string 170. In this way, this tensional force and gravities may exert tension on string 170 to stretch it over an airline or minimal distance within arcuate intermediate path 48. This operation accelerates to press string 170 within intermediate path 48 on guide surface 144 of fin 143 to cause it to slide on and go radially inwardly along guide surface 144, and finally, flexible string 170 is driven into capture space 147 for tangled engagement of string 147 with fins 143 as shown in FIGS. 7, 32 and 33.

In this case, once flexible sting 170 is entrapped in capture space 147, rotation of rotor 42 causes string 170 to be, inextricably without access to rotor 42, wound up around rotor 42 through capture space 147 and tangled with barb or barbs 145 of fins 143, and this certainly prevents unduly pullback or extraction of bill 35 and obviously improves in security and reliability of the bill handling apparatus.

[11] Disassembly of Bill Handling Apparatus

There is no particular order for disassembly of drive device 1, validator 2, stacker 3 and frame 4, and all or selected one or ones of them can be taken apart when needed. For example, after or without release of latch device 120, housing 20 of validator 2 may be removed from case 15 of drive device 1 along sliding connector 16 while disengaging input gear 21 of validator 2 from output gear 39 of drive device 1. Also, when handle 125 of latch device 120 is manually pulled downward, latchet lever 122 of latch device 120 is released from opening 82*a* in bracket 82 to remove follower 81 from cam guide 80 and to detach drive device 1 from frame 4 while disengaging posterior gears 12 of drive device 1 from drive gears 76 in stacker 3. Also, stacker 3 may be separably attached to frame 4 so that stacker 3 may be removed from frame 4 and drive device 1 as necessary. For example, U.S. Pat. No. 5,372,361 describes a detail of structure for a stacker removably attached to frame. In this way, the embodiment of the present invention enables drive device 1, validator 2, stacker 3 and frame 4 of the bill handling apparatus to disjoin into discrete modules or units under the disassembly method opposite to the assembly method for check, repair, overhaul or exchange of part or unit.

[12] Functions, Performances and Effects of Bill Handling Apparatus

[1] The unitized bill handling apparatus may be assembled by incorporation of individually modularized drive device 1, validator 2, stacker 3 and frame 4, and then disjoined into their incorporable and separable discrete modules for separate manufacture, assembly, disassembly, check, overhaul and exchange.

[2] After assemblage of the bill handling apparatus, the organically interlocked relation is accomplished by separable combination of drive device 1, validator 2 and stacker 3 to drivingly connect actuator 17 in drive device 1 with conveyer device 5 in validator 2 and carrier and pusher devices 6 and 7 in stacker 3.

[3] After separable assemblage of drive device 1, validator 2 and stacker 3, bill 35 may be consistently and continuously transported throughout passageway 10 of validator 2, intermediate path 48 and standby chamber 78 in stacker 3 by synchronous operation of drive device 1, conveyer device 5, carrier and pusher devices 6 and 7.

[4] A single drive device 1 can establish an integrated or centralized drive system for conveyer, carrier and pusher devices 5, 6 and 7 without need of any additional drive source and control device in validator 2 and stacker 3 both made in reduced weight, because drive device 1 has actuator 17 inclusive of transport and stowing motors 701 and 702 and drive control device.

[5] Drive device 1 may have built-in transport device 9 and anti-pullback unit 41 both driven by transport motor 701.

INDUSTRIAL APPLICABILITY

The present invention deals with a modularized document handler that comprises a modular drive device and a plurality of modular driven devices in particular such as a validator and a stacker drivingly and separably connected to the drive device.

What is claimed are:

1. A modularized document handler comprising:

a validator for validating a document, a stacker for stowing the document sent from the validator, and a drive device for transporting the document from the validator to the stacker through an intermediate path formed in the drive device, wherein the drive device comprises a drive unit, and a case for accommodating the drive unit, the drive unit comprises an actuator, a power transmission device driven by the actuator, a transport device driven by drive power of the actuator through the power transmission device, anterior and posterior gears both driven by drive power of the actuator through the power transmission device, a support frame for sustaining the actuator and power transmission device as a unit, and a pair of hinges formed in the support frame, the case is formed with a pair of bearings capable of detachably and rotatably receiving the hinges of the support frame, the drive unit is mounted within the case by fitting the hinges into the mating bearings and then rotating the drive unit toward inside of the case, the validator comprises a conveyer device for conveying the document to the drive device along a passageway formed in the validator, and a housing for encasing the conveyer device, the stacker comprises a carrier device for transporting the document from the intermediate path in the drive device to the stacker, the housing of the validator is detachably attached to the case of the drive device to disengageably and drivingly connect the conveyer device of the validator to the anterior gear in the drive unit and to drive the conveyer device of the validator by drive power of the actuator, the stacker is detachably attached to the drive device to disengageably and drivingly connect the carrier device of the stacker to the posterior gear in the drive unit to drive the carrier device of the stacker by drive power of the actuator, and the document is consistently transported from the passageway in the validator through the intermediate path in the drive device to the stacker.

2. The modularized document handler of claim 1, further comprising an output gear rotatably supported in the case, wherein the drive unit is rotated to a predetermined fixed position in the case to automatically and disengageably bring the anterior gear in the drive unit into engagement with the output gear, and the housing of the validator is detachably attached to the case of the drive device to disengageably and drivingly connect the conveyer device of the validator to the output gear.

3. The modularized document handler of claim 1, further comprising a sliding connector provided between the housing of the validator and the case of the drive device to detachably and slidably engage the housing with the case.

4. The modularized document handler of claim 3, wherein the sliding connector comprises a pair of rails secured on the case of the drive device, and sliders secured on the housing of the validator, the sliders have their cross-section complementary to those of the rails to detachably and slidably attach the sliders on the rails to detachably or separably mount the housing of the validator on the case of the drive device.

5. The modularized document handler of claim 1, wherein the posterior gear in the drive unit has transport and stowing gears, the actuator comprises transport and stowing motors, the transport gear is disengageably and drivingly connected to the carrier device of the stacker to transmit drive power of the transport motor to the carrier device through the power transmission device, the stowing gear is disengageably and drivingly connected to a pusher device of the stacker to transmit drive power of the stowing motor to the pusher device through the power transmission device.

6. A modularized document handler comprising:

a validator for validating a document, a stacker for stowing the document sent from the validator, a drive device for transporting the document from the validator to the stacker through an intermediate path formed in the drive device, and a frame for attaching the stacker and drive device thereto, wherein the drive device comprises a drive unit, and a case for accommodating the drive unit, the drive unit comprises an actuator, a power transmission device driven by the actuator, a transport device driven by drive power of the actuator through the power transmission device, and anterior and posterior gears both driven by drive power of the actuator through the power transmission device, the validator comprises a conveyer device for conveying the document to the drive device along a passageway formed in the validator, and a housing for encasing the conveyer device, the stacker comprises a carrier device for transporting the document from the intermediate path in the drive device to the stacker, the housing of the validator is detachably attached to the case of the drive device to disengageably and drivingly connect the conveyer device of the validator to the anterior gear in the drive unit and to drive the conveyer device of the validator by drive power of the actuator, the case of the drive device is detachably connected to the frame by a cam connector formed between the frame and the case of the drive device to automatically and disengageably bring the posterior gear in the drive unit into driving engagement with a drive gear in the carrier device of the stacker to drive the carrier device of the stacker by drive power of the actuator of the drive unit, and, the document is consistently transported from the passageway in the validator through the intermediate path in the drive device to the stacker.

7. The modularized document handler of claim 6, further comprising a sliding connector provided between the housing of the validator and the case of the drive device to detachably and slidably engage the housing with the case.

8. The modularized document handler of claim 7, wherein the sliding connector comprises a pair of rails secured on the case of the drive device, and sliders secured on the housing of the validator, the sliders have their cross-section complementary to those of the rails to detachably and slidably attach the sliders on the rails to detachably or separably mount the housing of the validator on the case of the drive device.

9. The modularized document handler of claim 6, wherein the cam connector comprises cam guides formed on a pair of vertically disposed side walls in the frame, and followers formed on a pair of vertically disposed side walls in the drive device, and the followers are inserted into mating cam guides to detachably attach the side walls of the drive device to the side walls of the frame.

10. The modularized document handler of claim 6, wherein the posterior gear in the drive unit has transport and stowing gears, the actuator comprises transport and stowing motors, the transport gear is disengageably and drivingly connected to the carrier device of the stacker to transmit drive power of the transport motor to the carrier device through the power transmission device, the stowing gear is disengageably and drivingly connected to a pusher device of the stacker to transmit drive power of the stowing motor to the pusher device through the power transmission device.

11. A modularized document handler comprising:

a drive device having a drive unit, a support frame for sustaining the drive unit, an intermediate path formed in the drive device and a case for accommodating the drive unit, a stacker having a carrier device that is disengageably and drivingly connected to the drive unit of drive device to transport the document from the intermediate path in the drive device to the stacker, and a frame formed with a cam connector between the frame and the case of the drive device, wherein the drive unit comprises an actuator, a power transmission device drivingly connected to the actuator and a posterior gear driven by the actuator through the power transmission device, the carrier device comprises a drive gear disengageably and drivingly connected to the posterior gear in the drive device, and the case of the drive device is detachably attached to the frame through the cam connector to automatically and disengageably bring the posterior gear in the drive device into driving engagement with the drive gear in the carrier device.

12. The modularized document handler of claim 11, wherein the drive device further comprises a transport device for conveying a document along the intermediate path toward the stacker, and an anti-pullback unit drivingly connected to the transport device to cause the anti-pullback unit to rotate by drive power of the actuator through the power transmission device.

13. The modularized document handler of claim 12, wherein the anti-pullback unit comprises a rotor rotated by the actuator through the power transmission device, and a support frame for rotatably sustaining the rotor, the rotor comprises a plurality of disks disposed coaxially, in a line and in spaced relation to each other and a plurality of fletched fins axially protruding from radial surfaces of the disks toward an opposite radial surface of adjoining spaced disks, each of the fins comprises a radially-outwardly tapered guide surface formed at the radially outer edge of the fin, and a barb formed at the radially inner edge of the fin.

* * * * *